US012158161B2

(12) United States Patent
Kim et al.

(10) Patent No.: US 12,158,161 B2
(45) Date of Patent: Dec. 3, 2024

(54) BLOWER

(71) Applicant: LG ELECTRONICS INC., Seoul (KR)

(72) Inventors: Juhyun Kim, Seoul (KR); Jaehyuk Jung, Seoul (KR); Jinwook Choi, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/237,494

(22) Filed: Aug. 24, 2023

(65) Prior Publication Data

US 2024/0077084 A1 Mar. 7, 2024

(30) Foreign Application Priority Data

Sep. 2, 2022 (KR) ..... 10-2022-0111499

(51) Int. Cl.
*F04D 29/40* (2006.01)
*F04D 23/00* (2006.01)

(52) U.S. Cl.
CPC ..... *F04D 29/403* (2013.01); *F04D 23/00* (2013.01)

(58) Field of Classification Search
CPC ..... F04D 25/08; F04D 29/002; F04D 29/30; F04D 29/441; F04D 29/703;
(Continued)

(56) References Cited

U.S. PATENT DOCUMENTS

2010/0226752 A1 9/2010 Gammack et al.
2021/0372413 A1 12/2021 Kim et al.
(Continued)

FOREIGN PATENT DOCUMENTS

KR 10-2011-7016151 9/2011
WO WO 2021/177713 9/2021

OTHER PUBLICATIONS

European Search Report dated May 3, 2024 issued in Application No. 23193205.4.

*Primary Examiner* — Aaron R Eastman
(74) *Attorney, Agent, or Firm* — KED & ASSOCIATES, LLP

(57) ABSTRACT

A blower of the present disclosure includes: a lower case having a suction port; an upper case which has a pair of towers that are spaced apart from each other and form a space through which a discharge air flows therebetween; and a blower fan which is disposed inside the lower case and discharges air to the upper case, wherein each of the pair of towers has a discharge port that is elongated in an up-down direction and disposed closer to a rear end of the tower than a front end, and has an air guide, which is disposed therein, that guides the air discharged by the blower fan to the discharge port, wherein the air guide is convex upward, has one end disposed near a middle between the front end and the rear end of the tower, and has the other end disposed near a middle of a vertical height of the discharge port, wherein the other end is disposed higher than the one end, so that the direction of air flow discharged from the fan can be smoothly switched to the discharge port side by only a single air guide, thereby minimizing the flow resistance inside the blower and greatly improving the economic efficiency and manufacturability of the blower.

9 Claims, 18 Drawing Sheets

(58) Field of Classification Search
CPC .. F04D 29/444; F04D 29/4226; F04D 29/403; F04D 23/00; F04D 29/263; F04F 5/16; F04F 5/44; F04F 5/461; F04F 5/466; F04F 5/48; F05D 2210/12
See application file for complete search history.

(56) References Cited

U.S. PATENT DOCUMENTS

2021/0372432 A1 12/2021 Jang et al.
2022/0205457 A1* 6/2022 Jung ..... F04D 29/703

* cited by examiner

BLOWER

CROSS-REFERENCE TO RELATED PATENT APPLICATIONS

This application claims priority to Korean patent application no. 10-2022-0111499, filed Sep. 2, 2022, whose entire disclosures are hereby incorporated by reference.

TECHNICAL FIELD

This disclosure relates to a blower for discharging air through the Coanda effect, and more particularly, to a blower having an air guide for guiding flow therein.

BACKGROUND

Conventional blowers generally have a blower fan in the lower space inside a case and a discharge nozzle on the upper side thereof, in order to implement a fan-less configuration that prevents the blower fan from being visible from the outside.

The blower of such a structure inevitably accompanies a technical problem that the air discharged from the blower fan to the upper side is not uniformly distributed over the entire area of the discharge nozzle due to a pressure difference according to the distance to the blower fan, but the blower's air volume is concentrated in a specific area inside the discharge nozzle, or the wind direction discharged from the discharge nozzle is deflected upward.

Accordingly, as disclosed in Korean Patent Publication No. KR20117016151A, the conventional blower includes a plurality of vane guides spaced apart along a discharge port of the discharge nozzle to evenly distribute the upward airflow discharged from the blower fan to the entire area of the discharge nozzle.

However, as the conventional blower has a plurality of vane guides on a flow path, there is a problem in that the internal flow resistance is rather increased and the discharge performance is deteriorated.

In addition, the conventional blower has a problem in that as a plurality of vane guides are manufactured, the manufacturability of the blower is lowered, and the installation process of the blower is complicated as each vane guide must be joined to an appropriate position inside the discharge nozzle.

SUMMARY

The disclosure has been made in view of the above problems, and may provide a blower including an air guide that evenly guides the air flowing from the lower side to the upper side inside a tower to a discharge port.

The disclosure may further provide a blower having an air guide for effectively guiding the internal flow while solving the above-described problem caused as a plurality of air guides are provided.

The disclosure may further provide a blower having an air guide with improved manufacturability and economy.

The disclosure may further provide a blower having an air guide with a simple installation process.

The disclosure may further provide a blower having an air guide that can respond by flexibly changing the installation position according to the conditions of the flow path inside the blower.

In accordance with an aspect of the present disclosure, a blower includes: a lower case having a suction port; an upper case which is disposed in an upper side of the lower case, and has a pair of towers that are spaced apart from each other and form a blowing space through which a discharge air flows therebetween; and a blower fan which is disposed inside the lower case and discharges air to the upper case, and includes a discharge port that is elongated in a rear end side of the tower.

The blower according to an embodiment of the present disclosure includes an air guide having a certain shape divides an internal flow path of the tower in half to deliver half of the air discharged from the fan to a half part of the discharge port and deliver the other half of the air to the other half part of the discharge port, so that the direction of air flow discharged from the fan can be smoothly switched to the discharge port side by at least a single air guide, and the air volume can be uniformly distributed over the entire area of the long discharge port.

For example, the air guide of the blower according to an embodiment of the present disclosure is convex upward, has one end disposed near a middle between the front end and the rear end of the tower, and has the other end disposed near a middle of a vertical height of the discharge port, wherein the other end is disposed higher than the one end.

Accordingly, the problem caused by being equipped with a plurality of air guides as described above can be solved, and furthermore, manufacturability, economic feasibility, and installability can be improved.

In addition, in the air guide of the blower according to an embodiment of the present disclosure, both end portions have a certain inclination angle, respectively, thereby minimizing the pressure loss due to the change in the flow direction of the air discharged from the fan.

In addition, in the air guide of the blower according to an embodiment of the present disclosure, both ends are in close contact with the inner wall of the tower, thereby improving the performance of the air guide by preventing the air flow from leaking through an unnecessary gap.

The air guide of a blower according to another embodiment of the present disclosure is provided with a plurality of air guides spaced apart along the longitudinal direction of the discharge port, wherein the plurality of air guides may be respectively connected to a bar link that is elongated in the up-down direction and connected to the inner wall of the tower.

Accordingly, even if the blower has a plurality of air guides, by reducing the inconvenience of fastening each air guide to the tower, and by simply inserting a bar link into the tower inner space to be fastened to the tower, the convenience of fastening the plurality of air guides can be improved.

In addition, by allowing each air guide to move in the up-down direction along the bar link, it is possible to flexibly respond to a situation in which the internal air flow path is changed, such as additional disposition of a structure in the tower.

Alternatively, each air guide may be installed by being simply inserted from the outside by a certain opening formed in the tower. In this case, the opening may be divided into one end portion facing the inner space of the tower and the other end portion facing the outside, and the other end portion may have a larger cross-sectional area than the one end portion. Accordingly, the air guide inserted through the opening from the outside may not fall into the tower by being supported by a step difference between one end portion and the other end portion inside the opening.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Figure 1:
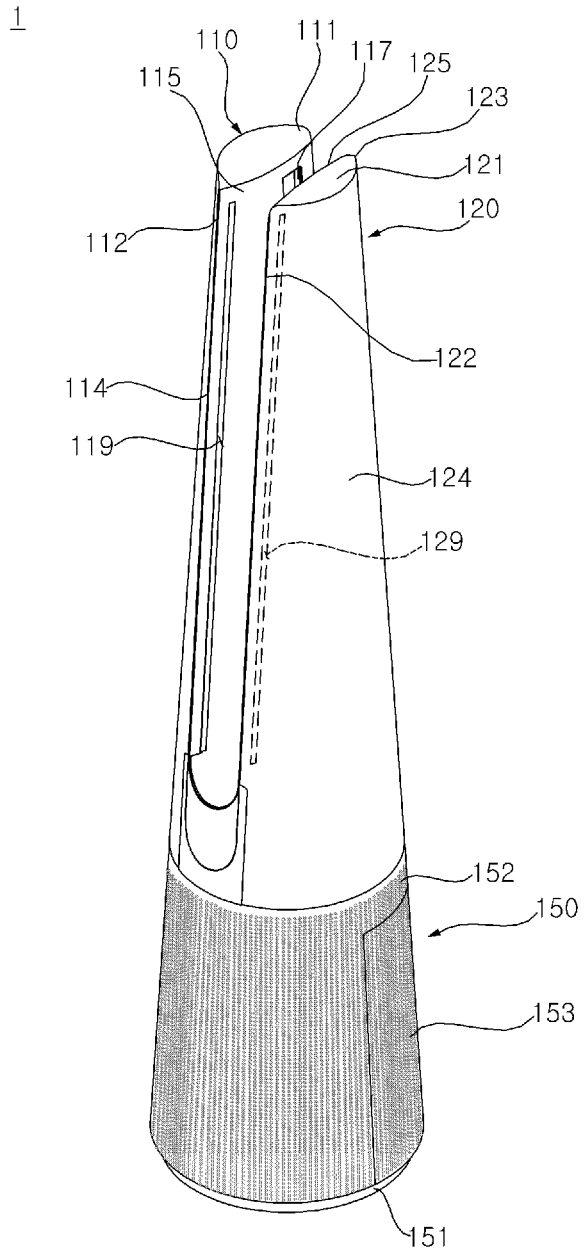
FIG. 1 is a perspective view of a blower according to an embodiment of the present disclosure.

Advantages and features of the present disclosure and methods of achieving them will become apparent with reference to the embodiments described below in detail in conjunction with the accompanying drawings. However, the present disclosure is not limited to the embodiments disclosed below, but may be implemented in various different forms, and these embodiments are provided only to allow the disclosure of the present disclosure to be complete, and to completely inform those of ordinary skill in the art to which the present disclosure belongs, the scope of the invention, and the present disclosure is only defined by the scope of the claims. Like reference numerals refer to like elements throughout.

In this description, a blower may mean an air blower, and furthermore, may mean an air purifier that performs an air cleaning function by having a filter, or mean an air clean fan that performs a blowing function and an air cleaning function simultaneously.

Figure 2:
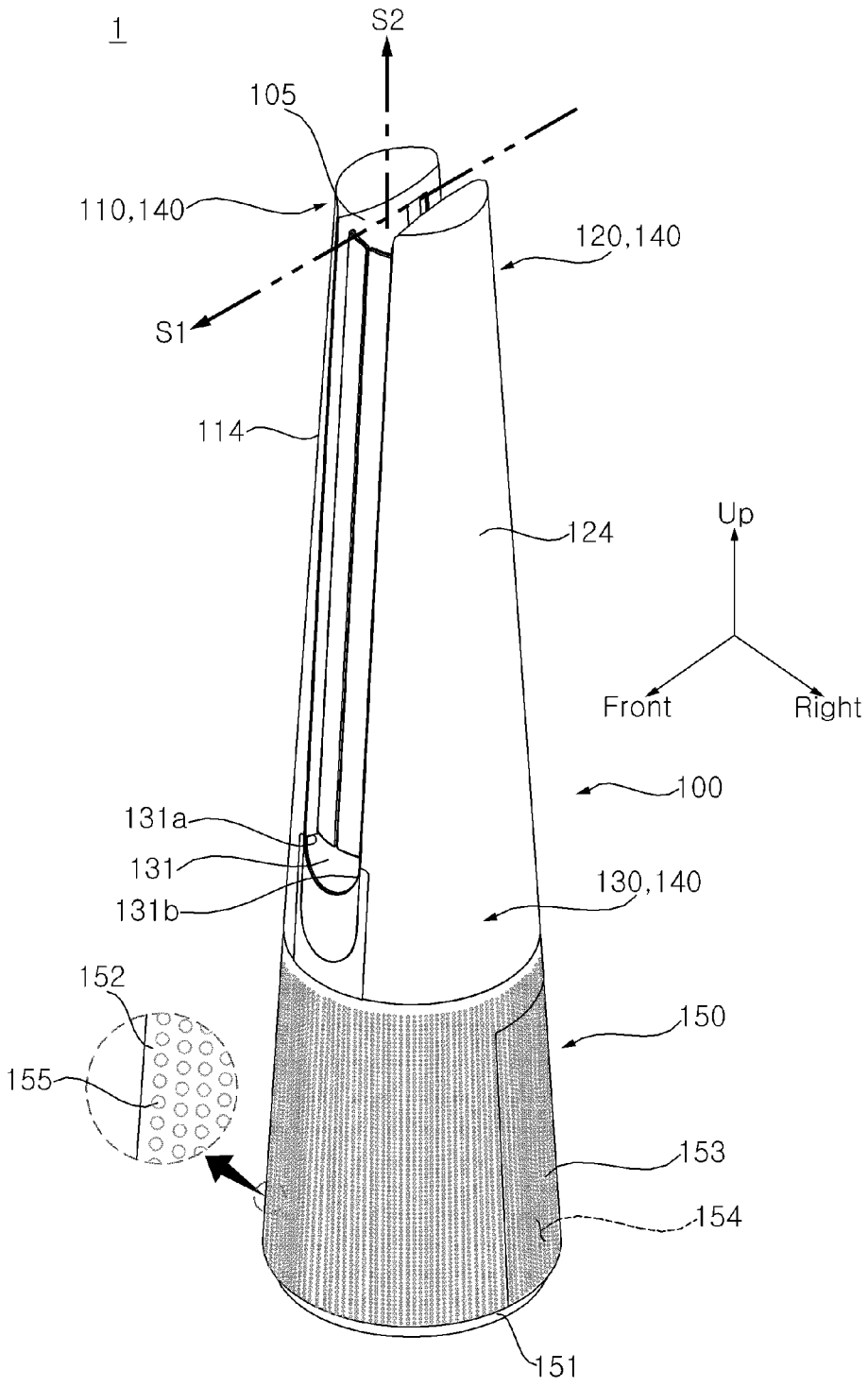
FIG. 2 is an exemplary view of operation of FIG. 1.
Figure 3:
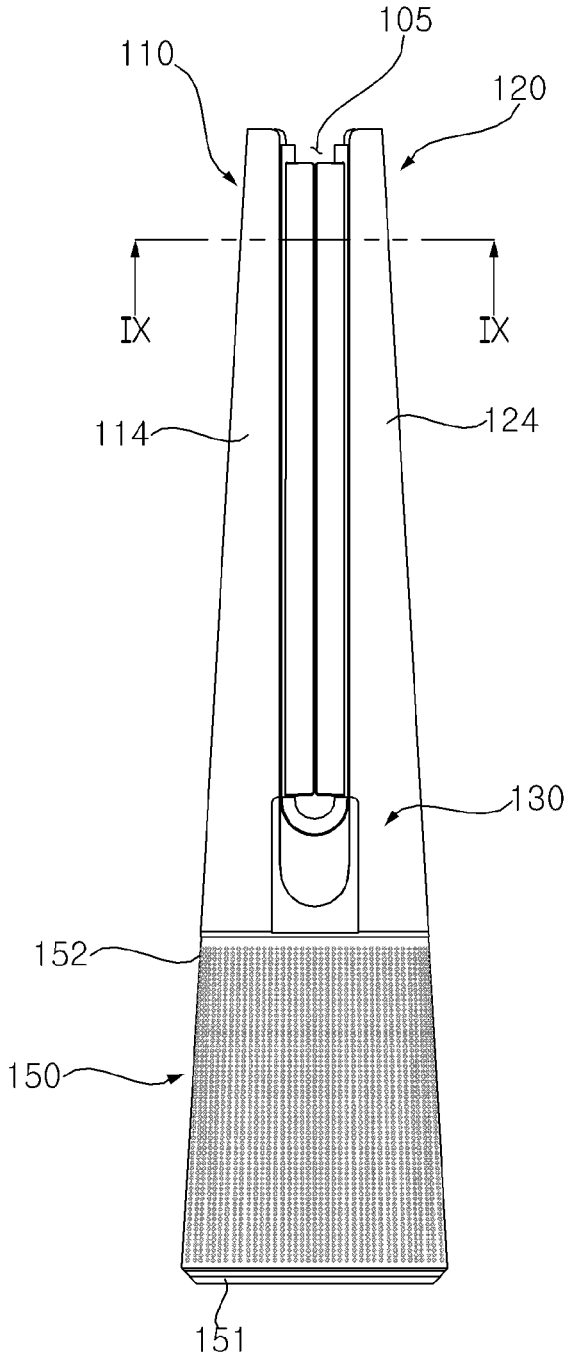
FIG. 3 is a front view of FIG. 2.
Figure 4:
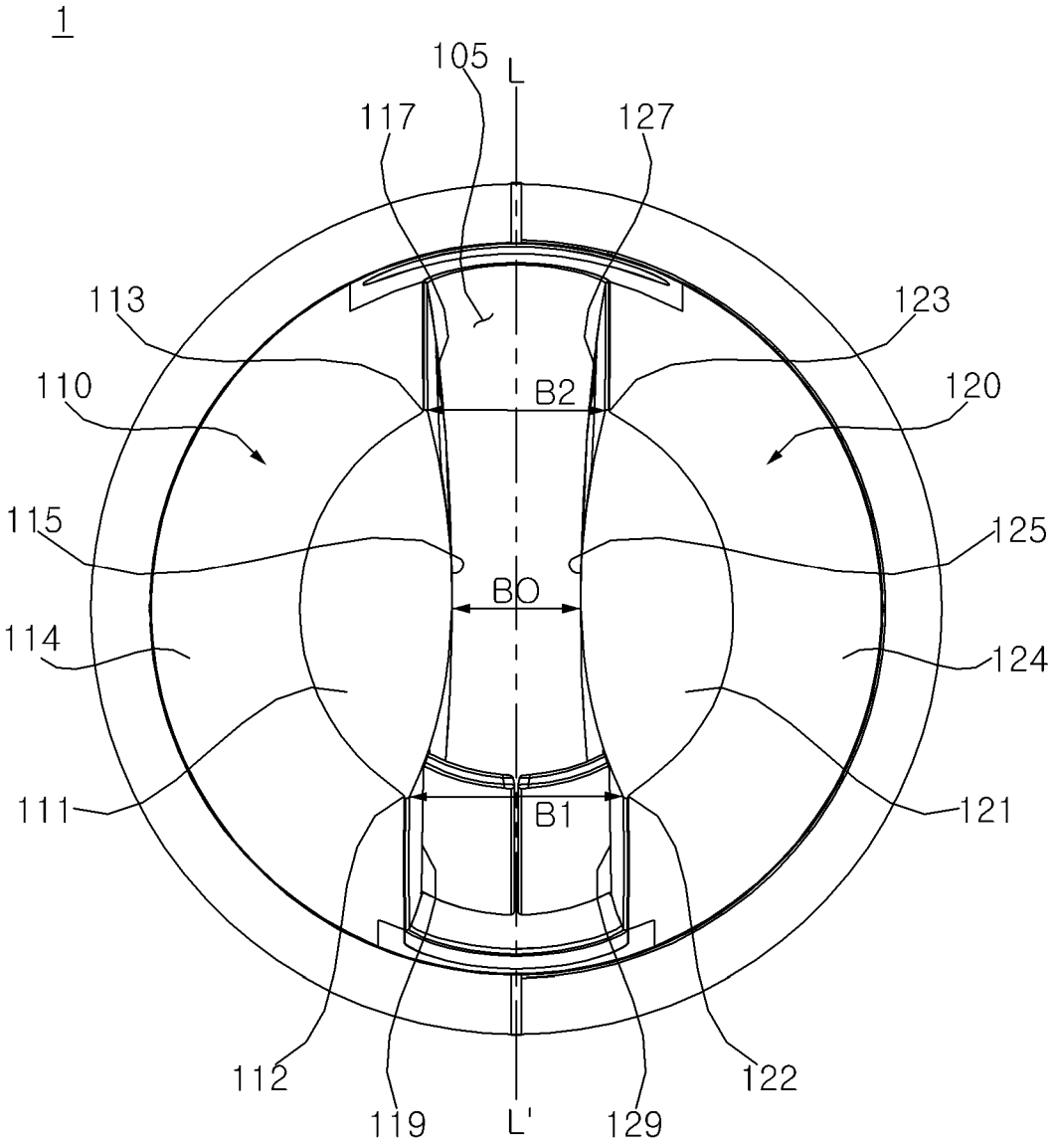
FIG. 4 is a plan view of FIG. 3.

FIG. 1 is a perspective view of a blower according to an embodiment of the present disclosure, FIG. 2 is an exemplary view of operation of FIG. 1, FIG. 3 is a front view of FIG. 2, and FIG. 4 is a plan view of FIG. 3.

Referring to FIGS. 1 to 4, a blower 1 according to an embodiment of the present disclosure includes a case 100 that provides an external shape. The case 100 includes a lower case 150 in which a filter 200 is installed, and an upper case 140 that discharges air through the Coanda effect.

In addition, the upper case 140 includes a first tower 110 and a second tower 120 disposed separately in the form of two pillars. In the present embodiment, the first tower 110 may be disposed in the left side, and the second tower 120 may be disposed in the right side.

The first tower 110 and the second tower 120 are spaced apart, and a blowing space 105 is formed between the first tower 110 and the second tower 120.

In the present embodiment, the blowing space 105 may have front, rear, and upper sides that are open, and the upper and lower ends of the blowing space 105 may be formed to have the same gap.

The upper case 140 including the first tower, the second tower and the blowing space may be formed in a truncated cone shape.

Discharge ports 117 and 127 respectively disposed in the first tower 110 and the second tower 120 discharge air to the blowing space 105. When it is necessary to distinguish the discharge ports, the discharge port formed in the first tower 110 is referred to as a first discharge port 117, and the discharge port formed in the second tower 120 is referred to as a second discharge port 127.

The first discharge port and the second discharge port may be disposed within the height of the blowing space, and a direction crossing the blowing space 105 is defined as an air discharge direction.

Since the first tower 110 and the second tower 120 are disposed in the left and right, the air discharge direction may be formed in a front-rear direction and an up-down direction in the present embodiment.

That is, the air discharge direction crossing the blowing space 105 may include a first air discharge direction S1 disposed in a horizontal direction and a second air discharge direction S2 formed in an up-down direction.

The air flowing in the first air discharge direction S1 is referred to as a horizontal airflow, and the air flowing in the second air discharge direction S2 is referred to as an upward airflow.

It should be understood that the horizontal airflow does not mean that the air flows only in the horizontal direction, but that the flow rate of the air flowing in the horizontal direction is greater. Similarly, it should be understood that the upward airflow does not mean that the air flows only in the upward direction, but that the flow rate of the air flowing in the upward direction is greater.

In the present embodiment, the upper gap and the lower gap of the blowing space 105 may be formed to be the same. Unlike the present embodiment, the upper gap of the blowing space 105 may be formed to be narrower or wider than the lower gap.

The flow of air flowing in the front of the blowing space may be more uniformly formed by uniformly forming the left-right width of the blowing space 105.

For example, when the width of the upper side is different from the width of the lower side, the flow velocity of the wide side may be formed low, and a deviation of the velocity may occur based on the up-down direction. When the air flow velocity deviation occurs in the up-down direction, the arrival length of the air may vary.

After the air discharged from the first discharge port and the second discharge port are joined in the blowing space 105, it may flow to a user.

That is, in the present embodiment, the discharge air of the first discharge port 117 and the discharge air of the second discharge port 127 do not individually flow to a user, but the discharge air of the first discharge port 117 and the discharge air of the second discharge port 127 are joined in the blowing space 105 and then provided to a user.

The blowing space 105 may be used as a space in which the discharge air is mixed. In addition, the air behind the blowing space may also flow into the blowing space by the discharge air discharged to the blowing space 105. Since the discharge air of the first discharge port 117 and the discharge air of the second discharge port 127 are joined in the blowing space, the straightness of the discharge air can be improved. In addition, the air around the first tower and the second tower can also indirectly flow in the air discharge direction, by joining the discharge air of the first discharge port 117 and the discharge air of the second discharge port 127 in the blowing space.

In the present embodiment, the first air discharge direction S1 may be formed from the rear to the front, and the second air discharge direction S2 may be formed from the lower side to the upper side.

An upper end 111 of the first tower 110 and an upper end 121 of the second tower 120 may be spaced apart for the second air discharge direction S2. That is, the air discharged in the second air discharge direction S2 does not interfere with a case of the blower 1.

In addition, for the first air discharge direction S1, a front end 112 of the first tower 110 and a front end 122 of the second tower 120 may be spaced apart, and a rear end 113 of the first tower 110 and a rear end 123 of the second tower 120 may also be spaced apart.

A surface facing the blowing space 105 in the first tower 110 and the second tower 120 is referred to as an inner surface, and a surface not facing the blowing space 105 is referred to as an outer surface.

An outer wall 114 of the first tower 110 and an outer wall 124 of the second tower 120 may be disposed in opposite directions to each other, and an inner wall 115 of the first tower 110 and an inner wall 125 of the second tower 120 may face each other.

When it is necessary to distinguish the inner walls 115 and 125, the inner surface of the first tower is referred to as a first inner wall 115, and the inner surface of the second tower is referred to as a second inner wall 125.

Similarly, when it is necessary to distinguish the outer walls 114 and 124, the outer surface of the first tower is referred to as a first outer wall 114, and the outer surface of the second tower is referred to as a second outer wall 124.

The first tower 110 and the second tower 120 may be formed in a streamlined shape with respect to the air flow direction.

Specifically, the first inner wall 115 and the first outer wall 114 may be formed in a streamlined shape with respect to the front-rear direction, and the second inner wall 125 and the second outer wall 124 may be formed in a streamlined shape with respect to the front-rear direction.

The first discharge port 117 may be disposed in the first inner wall 115, and the second discharge port 127 may be disposed in the second inner wall 125.

The shortest distance between the first inner wall 115 and the second inner wall 125 is referred to as B0. The discharge port 117, 127 may be located at a rear side of the shortest distance B0.

A separation distance between the front end 112 of the first tower 110 and the front end 122 of the second tower 120 is referred to as a first separation distance B1, and a separation distance between the rear end 113 of the first tower 110 and the rear end 123 of the second tower 120 is referred to as a second separation distance B2.

In the present embodiment, B1 and B2 may be formed to be the same. Unlike the present embodiment, any one of B1 and B2 may be formed to have a longer length.

The first discharge port 117 and the second discharge port 127 may be disposed between the B0 and B2.

Preferably, the first discharge port 117 and the second discharge port 127 are disposed closer to the rear end 113 of the first tower 110 and the rear end 123 of the second tower 120 than the B0.

As the discharge port 117, 127 is disposed close to the rear ends 113 and 123, it becomes easier to control the airflow through the Coanda effect described later.

The inner wall 115 of the first tower 110 and the inner wall 125 of the second tower 120 can directly provide the Coanda effect, and the outer wall 114 of the first tower 110 and the outer wall 124 of the second tower 120 may indirectly provide a Coanda effect.

The inner walls 115 and 125 may directly guide the air discharged from the discharge port 117, 127 to the front ends 112 and 122.

That is, the air discharged from the discharge port 117, 127 may directly provide a horizontal airflow.

Due to the air flow in the blowing space 105, an indirect air flow may also occur in the outer walls 114 and 124.

The outer walls 114 and 124 may induce a Coanda effect on the indirect air flow and guide the indirect air flow to the front ends 112 and 122.

The left side of the blowing space may be blocked by the first inner wall 115, the right side of the blowing space may be blocked by the second inner wall 125, but the upper side of the blowing space 105 may be open.

An airflow converter described later may convert a horizontal airflow passing through the blowing space into an upward airflow, and the upward airflow may flow to an open upper side of the blowing space. The upward airflow may prevent the discharge air from flowing directly to a user, and actively convect the indoor air.

In addition, it is possible to adjust the width of the discharge air through the flow rate of air joined in the blowing space.

The discharge air of the first discharge port and the discharge air of the second discharge port may be induced to join in the blowing space, by forming the vertical length of the first discharge port 117 and the second discharge port 127 to be much longer than the left-right width B0, B1, B2 of the blowing space.

Referring to FIGS. 1 to 3, the case 100 of the blower 1 according to an embodiment of the present disclosure includes a lower case 150 in which a filter is detachably installed, and an upper case 140 which is disposed in the upper side of the lower case 150 and supported by the lower case 150.

The upper case 140 includes the first tower 110 and the second tower 120.

In the present embodiment, a tower base 130 connecting the first tower 110 and the second tower 120 may be disposed, and the tower base 130 may be assembled to the lower case 150. The tower base 130 may be manufactured as one body with the first tower 110 and the second tower 120.

Unlike the present embodiment, the first tower 110 and the second tower 120 may be directly assembled to the lower case 150 without the tower base 130, and may be manufactured as one body with the lower case 150.

The lower case 150 may form a lower portion of the blower 1, and the upper case 140 may form an upper portion of the blower 1.

The blower 1 may suck in ambient air from the lower case 150, and discharge air filtered from the upper case 140. The upper case 140 may discharge air at a position higher than the lower case 150.

The blower 1 may be in the shape of a column whose diameter decreases toward the upper portion. The blower 1 may have a conical or truncated cone shape as a whole. In particular, a flat cross-section inside the tower, which will be described later, is formed to become narrower as the distance from the blower fan increases, so that a uniform discharge flow rate can be secured over the entire tower formed elongated in the up-down direction.

Unlike the present embodiment, the blower 1 may include a shape in which two towers are disposed. In addition, unlike the present embodiment, the cross section does not need to be narrowed toward the upper side.

However, when the cross section becomes narrower toward the upper side as in the present embodiment, the center of gravity is lowered and the risk of overturning due to external impact is reduced.

For the convenience of assembly, in the present embodiment, the lower case 150 and the upper case 140 may be separately manufactured.

Unlike the present embodiment, the lower case 150 and the upper case 140 may be formed as one body. For example, the lower case and the upper case may be assembled after being manufactured in the form of a front case and a rear case integrally manufactured as one body.

In the present embodiment, the lower case 150 may be formed to gradually decrease in diameter as it progresses toward the upper end. The upper case 140 may also be formed to gradually decrease in diameter as it progresses toward the upper end.

The outer surfaces of the lower case 150 and the upper case 140 may be continuously formed. In particular, the lower end of the tower base 130 and the upper end of the lower case 150 may be in close contact, and the outer surface of the tower base 130 and the outer surface of the lower case 150 may form a continuous surface.

To this end, the diameter of the lower end of the tower base 130 may be equal to or slightly smaller than the diameter of the upper end of the lower case 150.

The tower base 130 may distribute the filtered air supplied from the base 150 tower, and may provide the distributed air to the first tower 110 and the second tower 120.

The tower base 130 may connect the first tower 110 and the second tower 120, and the blowing space 105 may be disposed in the upper side of the tower base 130.

In addition, the discharge port 117, 127 may be disposed in the upper side of the tower base 130, and the upward airflow and the horizontal airflow may be formed in the upper side of the tower base 130.

In order to minimize friction with air, the upper surface 131 of the tower base 130 may be formed in a curved surface. In particular, the upper surface may be formed as a curved surface concave downward, and may be formed to extend in the front-rear direction. One side 131*a* of the upper side surface 131 may be connected to the first inner wall 115, and the other side 131*b* of the upper side surface 131 may be connected to the second inner wall 125.

Referring to FIG. 4, in a top view, the first tower 110 and the second tower 120 may be bilaterally symmetrical with respect to a center line L-L'. In particular, the first discharge port 117 and the second discharge port 127 may be symmetrically disposed with respect to the center line L-L'.

The center line L-L' is a virtual line between the first tower 110 and the second tower 120, and may be disposed in the front-rear direction in the present embodiment, and may be disposed to pass the upper side surface 131.

Unlike the present embodiment, the first tower 110 and the second tower 120 may be formed in an asymmetrical shape. However, if the first tower 110 and the second tower 120 are symmetrically disposed based on the center line L-L', it is more advantageous to control the horizontal airflow and the upward airflow.

Figure 5:
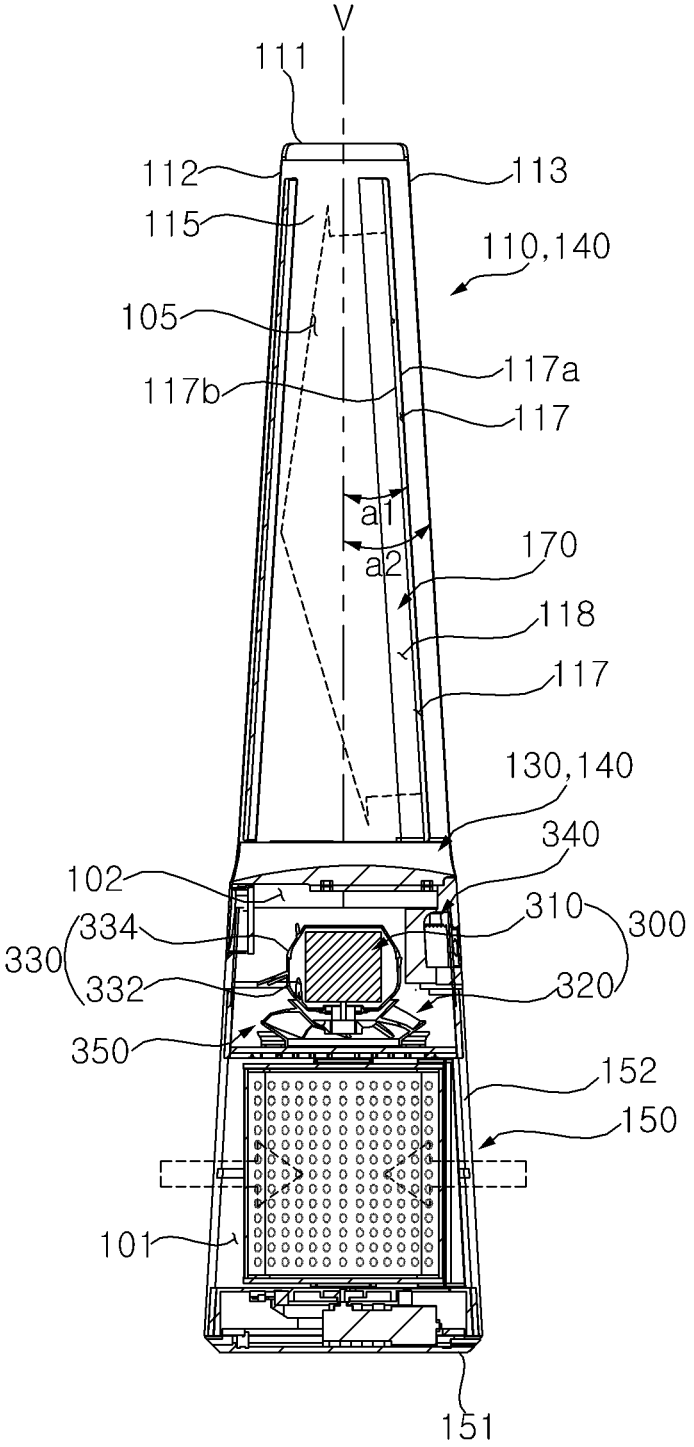
FIG. 5 is a right cross-sectional view of FIG. 2.
Figure 6:
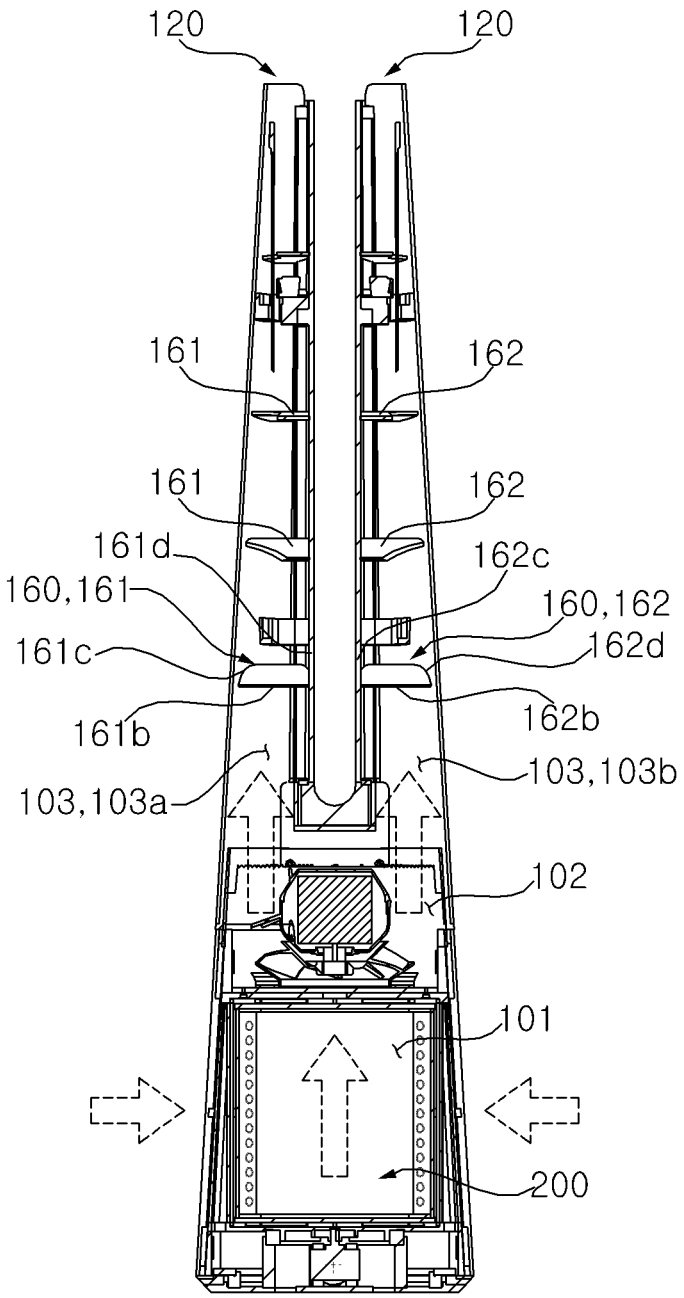
FIG. 6 is a front cross-sectional view of the blower according to a first embodiment of the present disclosure.

FIG. 5 is a right sectional view of FIG. 2, and FIG. 6 is a front sectional view of FIG. 2.

Referring to FIG. 1, 5 or 6, the blower 1 may include a filter 200 disposed inside the case 100. The blower includes a fan device 300 disposed inside the case 100 to flow air to the discharge port 117, 127.

In the present embodiment, the filter 200 and the fan device 300 may be disposed inside the lower case 150.

The lower case 150 may be formed in a truncated cone shape, and an upper side may be opened in the present embodiment.

The lower case 150 may include a base 151 seated on the ground, and a base outer 152 that is coupled to the upper side of the base 151, has a space formed therein, and has a suction port 155.

In a top view, the base 151 may be formed in a circular shape. The shape of the base 151 may be variously formed.

The base outer 152 may be formed in the shape of a truncated cone with upper and lower sides open. In addition, a portion of a side surface of the base outer 152 may be opened. An open portion of the base outer 152 may be referred to as a filter insertion port 154.

The case 100 may further include a cover 153 for shielding the filter insertion port 154. The cover 153 may be detachably assembled from the base outer 152, and the filter 200 may be mounted or assembled to the cover 153.

A user may remove the cover 153 to take the filter 200 out of the case 100.

The suction port 155 may be formed in at least one of the base outer 152 and the cover 153. In the present embodiment, the suction port 155 may be formed in both the base outer 152 and the cover 153, and may suck air in 360 directions around the case 100.

In the present embodiment, the suction port 155 may be formed in a hole shape, and the shape of the suction port 155 may be variously formed.

The filter 200 may be formed in a cylindrical shape having a vertical hollow therein. An outer surface of the filter 200 may face the suction port 155.

Indoor air may flow through the inside of the filter 200 from the outside, and in this process, foreign substances or harmful gases in the air may be removed.

The fan device 300 may be disposed in the upper side of the filter 200. The fan device 300 may flow the air that has passed through the filter 200 to the first tower 110 and the second tower 120.

The fan device 300 may include a fan motor 310 and a fan 320 rotated by the fan motor 310, and may be disposed inside the lower case 150.

The fan motor 310 may be disposed above the fan 320, and a motor shaft of the fan motor 310 may be coupled to the fan 320 disposed below.

A motor housing 330 in which the fan motor 310 is installed may be disposed in the upper side of the fan 320.

In the present embodiment, the motor housing 330 may have a shape that surrounds the entire fan motor 310. Since the motor housing 330 surrounds the entire fan motor 310, flow resistance with air flowing from the lower side to the upper side can be reduced.

Unlike the present embodiment, the motor housing 330 may be formed in a shape that surrounds only the lower portion of the fan motor 310.

The motor housing 330 may include a lower motor housing 332 and an upper motor housing 334. At least one of the lower motor housing 332 and the upper motor housing 334 may be coupled to the case 100.

In the present embodiment, the lower motor housing 332 may be coupled to the case 100. After the fan motor 310 is installed in the upper side of the lower motor housing 332, the fan motor 310 may be covered by covering the upper motor housing 334.

The motor shaft of the fan motor 310 may pass through the lower motor housing 332, and may be assembled to the fan 320 disposed below.

The fan 320 may include a hub to which the shaft of the fan motor is coupled, a shroud spaced apart from the hub, and a plurality of blades connecting the hub and the shroud.

After the air that has passed through the filter 200 is sucked into the shroud, it may flow by being pressurized by the rotating blade. The hub may be disposed in the upper side of the blade, and the shroud may be disposed in the lower side of the blade. The hub may be formed in a downwardly concave bowl shape, and a lower side of the lower motor housing 332 may be partially inserted.

In the present embodiment, the fan 320 may be a mixed flow fan. The mixed flow fan sucks air into the center of the shaft and discharges air in the radial direction, but the discharged air is formed to be inclined with respect to the shaft direction.

Since the overall air flow flows from the lower side to the upper side, if air is discharged in a radial direction like a general centrifugal fan, a flow loss due to the flow direction change is greatly generated.

The mixed flow fan can minimize the flow loss of air by discharging air upward in the radial direction.

Meanwhile, a diffuser 340 may be further disposed in the upper side of the fan 320. The diffuser 340 may guide the air flow caused by the fan 320 upward.

The diffuser 330 serves to further reduce a radial component in the air flow and enhance an upward direction air flow component.

The motor housing 330 may be disposed between the diffuser 330 and the fan 320.

In order to minimize the vertical installation height of the motor housing, the lower end of the motor housing 330 may be inserted into the fan 320 and overlap the fan 320. In addition, the upper end of the motor housing 330 may be inserted into the diffuser 340 and overlap the diffuser 340.

Here, the lower end of the motor housing 330 may be disposed higher than the lower end of the fan 320, and the upper end of the motor housing 330 may be disposed lower than the upper end of the diffuser 340.

In order to optimize the installation position of the motor housing 330, in the present embodiment, the upper side of the motor housing 330 may be disposed inside the tower base 130, and the lower side of the motor housing 330 may be disposed inside the lower case 150. Unlike the present embodiment, the motor housing 330 may be disposed inside the tower base 130 or the lower case 150.

Meanwhile, a suction grill 350 may be disposed inside the lower case 150. The suction grill 350 is for protecting a user and the fan 320 by blocking user's fingers from intruding into the fan 320, when the filter 200 is separated.

The filter 200 may be disposed in the lower side of the suction grill 350, and the fan 320 may be disposed in the upper side of the suction grill 350. The suction grill 350 may be formed with a plurality of through-holes in the up-down direction so that air can flow.

Inside the case 100, a space below the suction grill 350 is defined as a filter installation space 101. A space between the suction grill 350 and the discharge port 117, 127 inside the case 100 is defined as a ventilation space 102. An inner space of the first tower 110 and the second tower 120 in which the discharge port 117, 127 is disposed inside the case 100 is defined as a discharge space 103.

The indoor air may flow into the filter installation space 101 through the suction port 155, and then be discharged to the discharge port 117, 127 through the ventilation space 102 and the discharge space 103.

Figure 8:
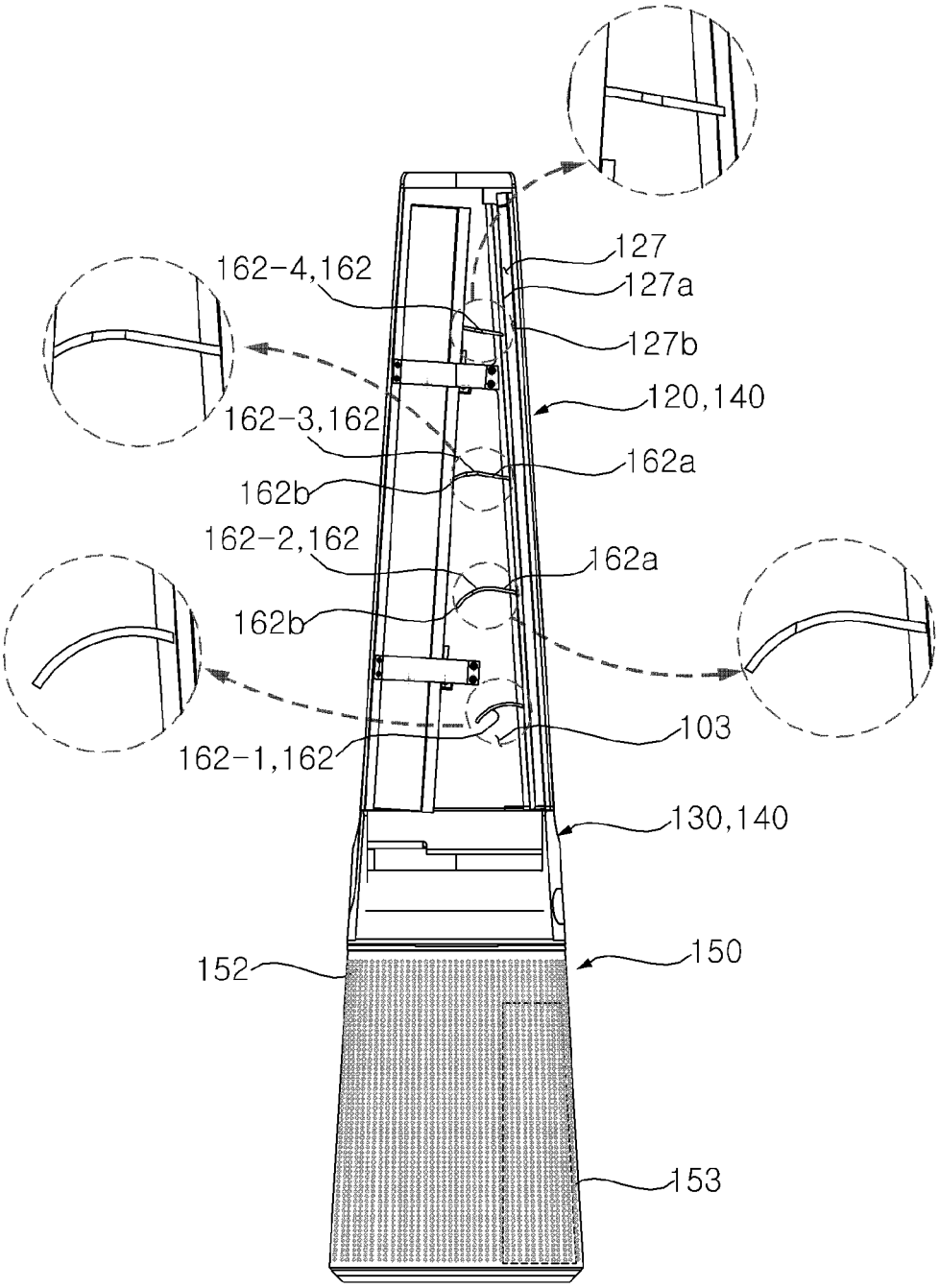
FIG. 8 is a right side view of FIG. 7.

Next, referring to FIG. 5 or 8, the first discharge port 117 and the second discharge port 127 according to the present embodiment may be disposed to extend in the up-down direction.

The first discharge port 117 may be disposed between the front end 112 and the rear end 113 of the first tower 110, and may be disposed close to the rear end 113. The air discharged from the first discharge port 117 may flow along the first inner wall 115 due to the Coanda effect, and may flow toward the front end 112.

The first discharge port 117 may include a first border 117*a* forming an edge of air discharge side (front end in the present embodiment), a second border 117*b* forming an edge of air discharge opposite side (rear end in the present embodiment), an upper border 117*c* forming an upper edge of the first discharge port 117, and a lower border 117*d* forming a lower edge of the first discharge port 117.

In the present embodiment, the first border 117*a* and the second border 117*b* may be disposed parallel to each other. The upper border 117*c* and the lower border 117*d* may be disposed parallel to each other.

The first border 117*a* and the second border 117*b* may be disposed to be inclined with respect to a vertical direction V. In addition, the rear end 113 of the first tower 110 may also be inclined with respect to the vertical direction V.

In the present embodiment, the inclination a1 of the first border 117*a* and the second border 117*b* with respect to the vertical direction V may be formed at 4 degrees, and the inclination a2 of the rear end 113 may be formed at 3 degrees. That is, the inclination a1 of the discharge port 117 may be formed to be greater than the inclination of the outer surface of the tower.

The second discharge port 127 may be bilaterally symmetrical with the first discharge port 117.

The second discharge port 127 may include a first border 127*a* forming an edge of air discharge side (front end in the present embodiment), a second border 127*b* forming an edge of air discharge opposite side (rear end in the present embodiment), an upper border 127*c* forming an upper edge of the second discharge port 127, and a lower border 127*d* forming a lower edge of the second discharge port 127.

The first border 127*a* and the second border 127*b* may be inclined in the vertical direction V, and the rear end 113 of the first tower 110 may also be inclined in the vertical direction V. In addition, the inclination a1 of the discharge port 127 may be formed to be greater than the inclination a2 of the outer surface of the tower.

An air guide 160 for converting the flow direction of air into a horizontal direction is disposed in the discharge space 103. The air guide 160 may convert the direction of the air flowing from the lower side to the upper side into a horizontal direction, and the converted air may flow to the discharge port 117, 127. In addition, the air guide 160 may allow the air to be evenly distributed over the entire surface of the elongated discharge port.

When it is necessary to distinguish the air guides, the air guide disposed inside the first tower 110 is referred to as a first air guide 161, and the air guide disposed inside the second tower 120 is referred to as a second air guide 162. The first air guide 161 and the second air guide 162 may be symmetrical to each other. In order to avoid repetition of the same description, it is natural that the description of one of the two air guides may also be applied to the other air guide, even if not specifically mentioned below.

Figure 7:
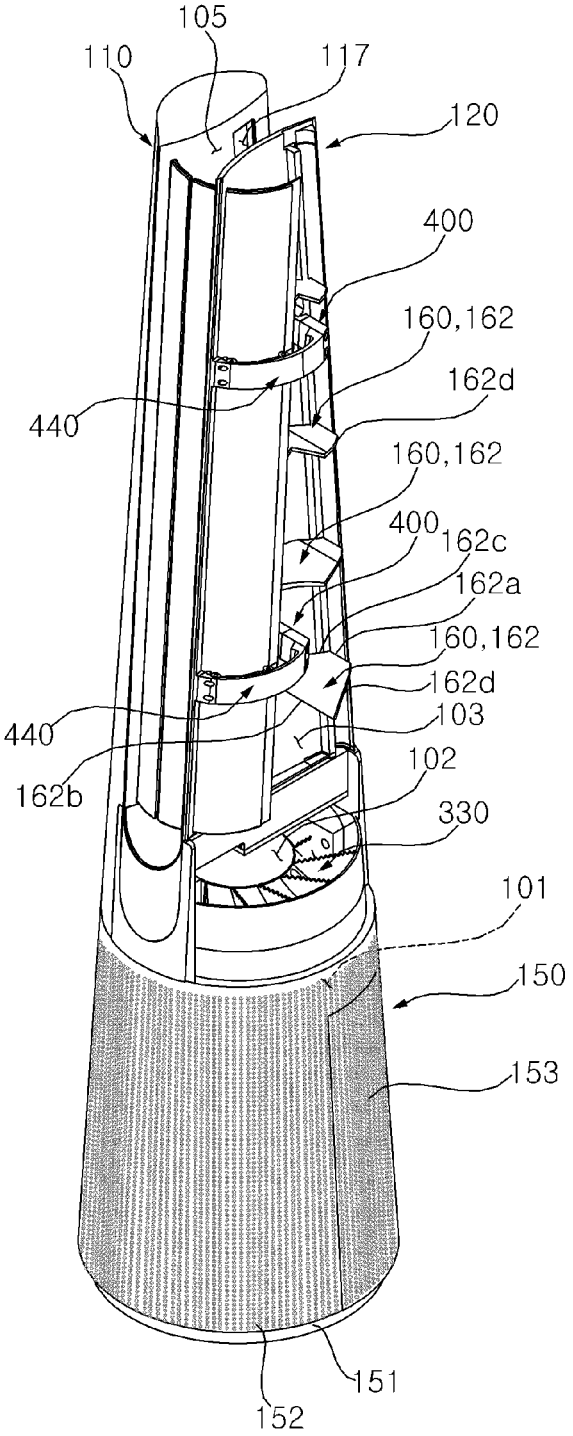
FIG. 7 is a partially exploded perspective view of the blower according to the first embodiment of the present disclosure.

Referring to FIGS. 6 to 8, according to a first embodiment of the present disclosure, a plurality of the air guides 160 may be disposed. A plurality of first air guides 161 may be disposed, and the plurality of first air guides 161 may be disposed in an up-down direction. A plurality of second air guides 162 may be disposed, and the plurality of second air guides 162 may be disposed in an up-down direction.

In order to guide the air flowing in the lower side to the first discharge port 117, at least one of the plurality of first air guides 161 may have a curved surface convex from the lower side to the upper side.

At least one of the plurality of first air guides 161 may have the front side end (i.e., front end) 161*b* disposed lower than the rear side end (i.e., rear end) 161*a*. Thus, air can be guided to the first discharge port 117 while minimizing resistance with the air flowed from the lower side.

When viewed from the front, the first air guide 161 may be coupled to the inner wall and/or the outer wall of the first tower 110. At least a portion of a left side end 161*c* of the first air guide 161 may be in close contact with or coupled to the left wall of the first tower 110. At least a portion of a right side end 161*d* of the first air guide 161 may be in close contact with or coupled to the right wall of the first tower 110.

When viewed from the side, the rear side end 161*a* of the first air guide 161 may be close to the first discharge port 117, and the front side end 161*b* may be spaced apart from the front end of the first tower 110.

The air moving upward along the discharge space 103 may flow from the front end of the first air guide 161 to the rear end.

The second air guide 162 may be bilaterally symmetrical with the first air guide 161.

When viewed from the front, the second air guide 162 may be coupled to the inner wall and/or the outer wall of the second tower 110. When viewed from the side, the rear side end (i.e., the rear end) 162*a* of the second air guide 162 may be close to the second discharge port 127, and the front side end (i.e., the front end) 162*b* may be spaced apart from the front end of the second tower 120.

In order to guide the air flowing in the lower side to the second discharge port 127, at least one of the plurality of second air guides 162 may be formed as a curved surface convex from the lower side to the upper side.

At least one of the plurality of second air guides 162 may have the front side end 162*b* disposed lower than the rear side end 162*a*, thereby minimizing resistance with the air flowing in the lower side, and guiding air to the second discharge port 127.

At least a part of the left side end 162*c* of the second air guide 162 may be in close contact with or coupled to the left wall (inner wall) of the second tower 120. At least a part of the right side end 162*d* of the second air guide 162 may be in close contact with or coupled to the right wall (outer wall) of the second tower 120.

Referring to FIG. 8, in the first embodiment, four second air guides 162 may be disposed, and may be referred to as a second-first air guide 162-1, a second-second air guide 162-2, a second-third air guide 162-3, and a second-fourth air guide 162-4 respectively from the lower side to the upper side.

The second-first air guide 162-1 and the second-second air guide 162-2 may have the front end 162*b* disposed lower than the rear end 162*a*, and may guide the air toward the rear upper side.

On the other hand, the second-third air guide 162-3 and the second-fourth air guide 162-4 may have the rear end 162*a* lower than the front end 162*b*, and guide the air toward the rear lower side.

The disposition of the air guides is to allow the discharge air to converge to the middle of the height of the blowing space 105, and through this, a reach distance of the discharge air can be increased.

The second-first air guide 162-1 and the second-second air guide 162-2 may be formed respectively in a curved surface convex upwards, and the second-first air guide 162-1 disposed in the lower side may be formed to be more convex than the second-second air guide 162-2.

The second-third air guide 162-3 disposed in the lower side, among the second-third air guide 162-3 and the second-fourth air guide 162-4, is convex upwards, but the second-fourth air guide 162-4 may be formed in a flat plate shape.

The second-second air guide 162-2 disposed in the lower side may form a curved surface more convex than the second-third air guide 162-3. That is, the curved surface of the air guide may be gradually flattened from the lower side to the upper side.

The second-fourth air guide 162-4 disposed in the uppermost side may have a rear end 162*a* lower than the front end 162*b* and may be formed in a flat shape.

Figure 9:
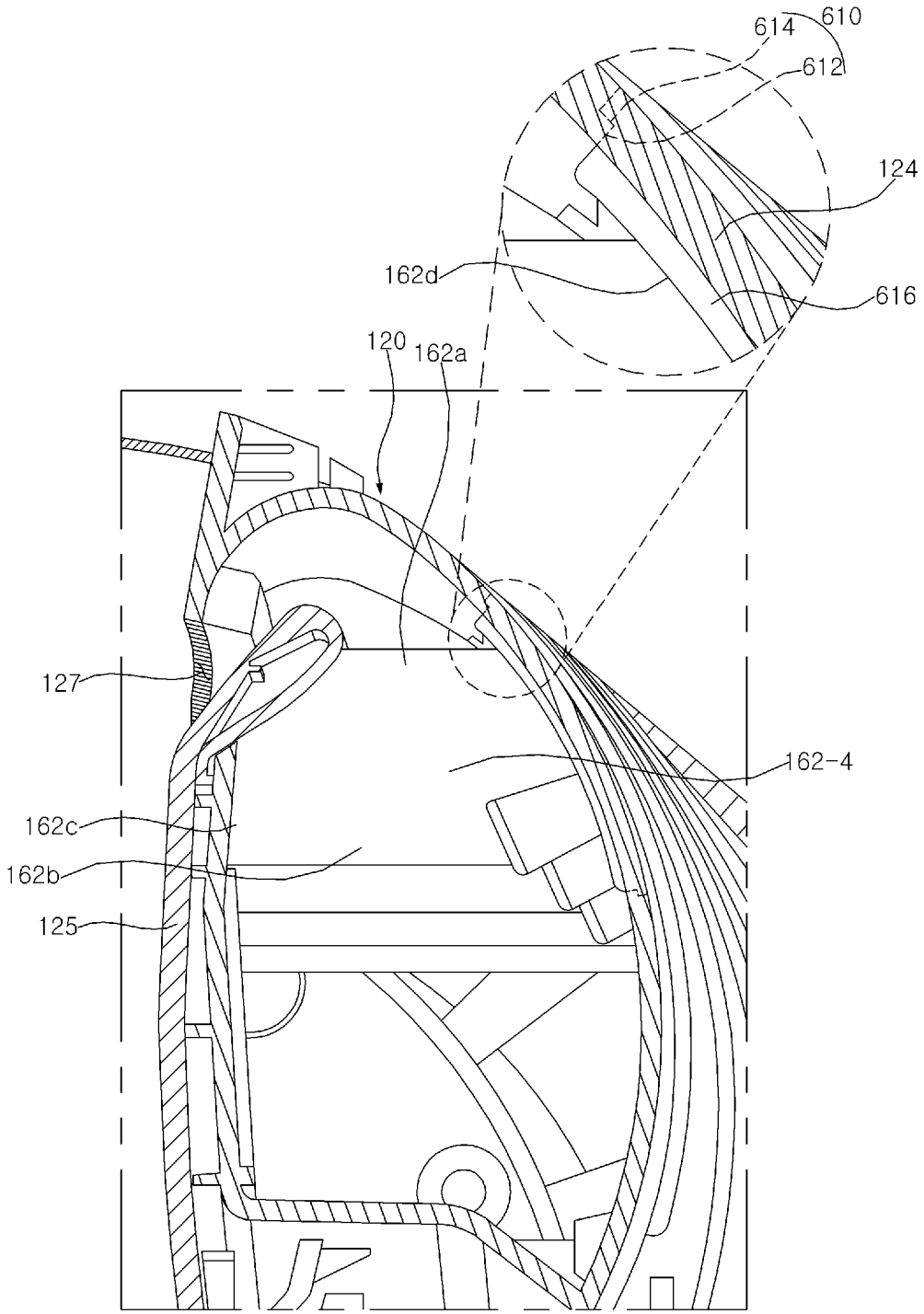
FIG. 9 is a top cross-sectional view of a blower according to the first embodiment of the present disclosure having an opening in a tower.

According to the first embodiment, the plurality of air guides 160 may be inserted into and fixed to the inner and/or outer wall of the tower 110, 120, respectively. For example, referring to FIG. 9, the plurality of second air guides 162 may be respectively inserted into the outer wall (i.e., the second outer wall) 124 of the second tower 120. The plurality of air guides may be firmly fixed by being inserted into the outer wall of the tower, respectively.

For the fastening of the air guide 160, an opening 610 having a shape corresponding to the side cross-section of the air guide may be formed in the outer wall 114, 124 of the tower. The air guide 160 is inserted into the inside of the tower through the opening 610 of the tower outer wall 114, 124. That is, the opening 610 of the outer wall of the tower may be an insertion hole into which the air guide 160 is inserted from the outside.

Accordingly, the air guide can be easily inserted and fastened from the outside of the tower, thereby improving an installation convenience.

The opening 610 of the tower outer wall includes one end portion 612 connected to an inner space of the tower and the other end portion 614 connected to an outer space. The cross-sectional area of the other end portion 614 is formed to be larger than the cross-sectional area of the one end portion 612. For example, a step in which the cross-sectional area of the opening becomes narrower from the other end portion 614 toward the one end portion 612 may be formed. The air guide 160 may include an extension 616 having a shape corresponding to one end portion 612 and the other end portion 614 of the opening 610. The extension 616 may be formed to extend outwardly from the right side end 162*d* of the air guide 160. Accordingly, the air guide inserted through the opening from the outside may be supported by the step inside the opening and may not fall into the tower.

Meanwhile, when it is necessary to secure a space inside the tower in order to additionally dispose a structure such as a heater inside the tower, the air guide fastened through the above-described opening 610 can be easily detached, thereby increasing the utilization of the blower.

Figure 10:
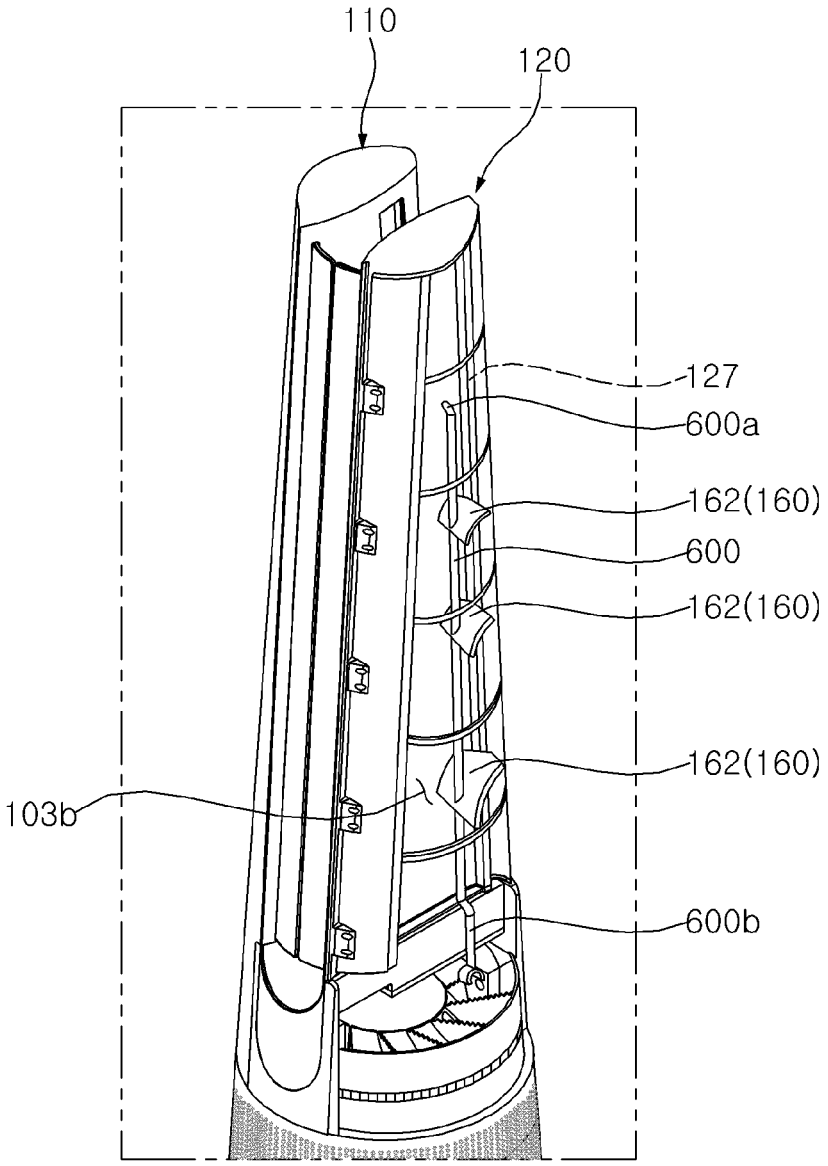
FIG. 10 is a perspective view of the blower according to the first embodiment of the present disclosure having a bar link.
Figure 11:
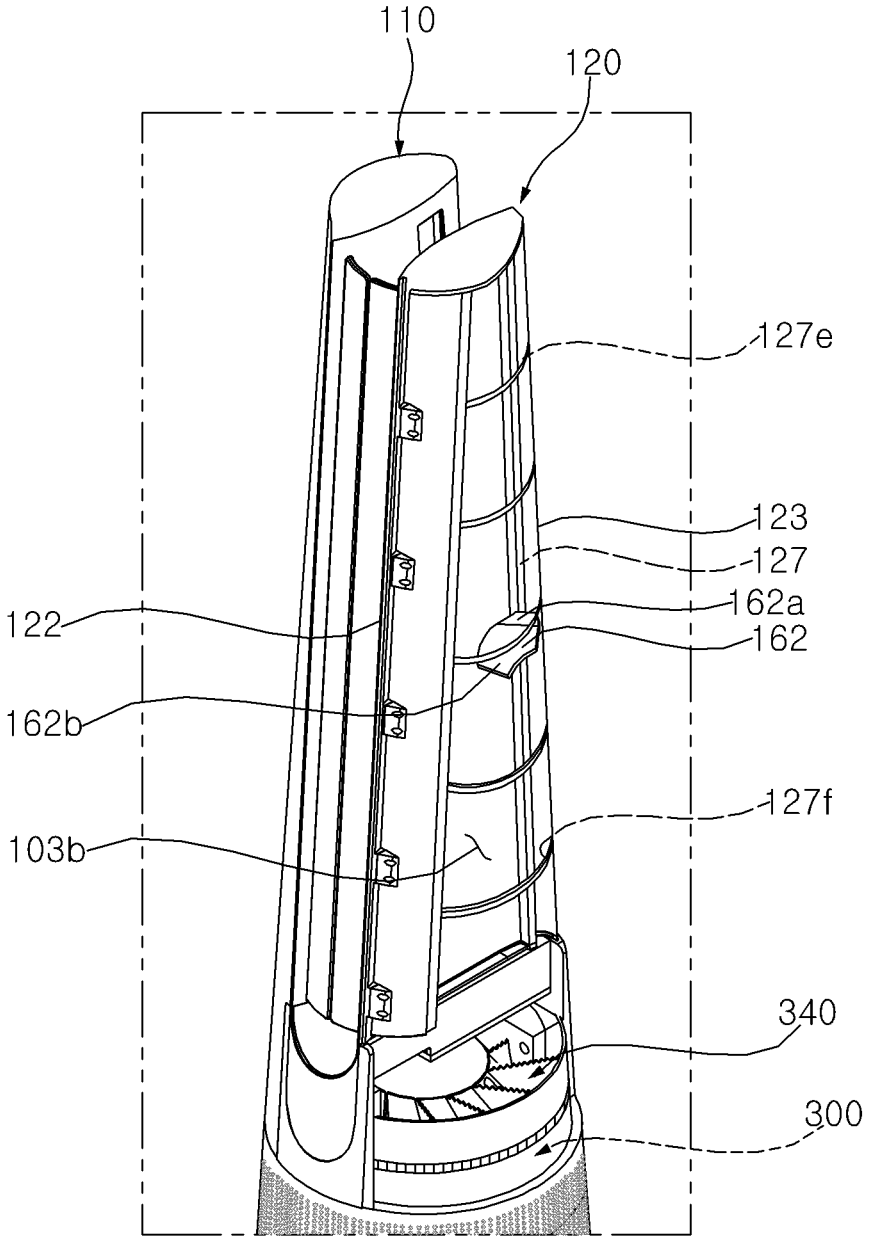
FIG. 11 is a perspective view of a blower according to a second embodiment of the present disclosure.
Figure 12:
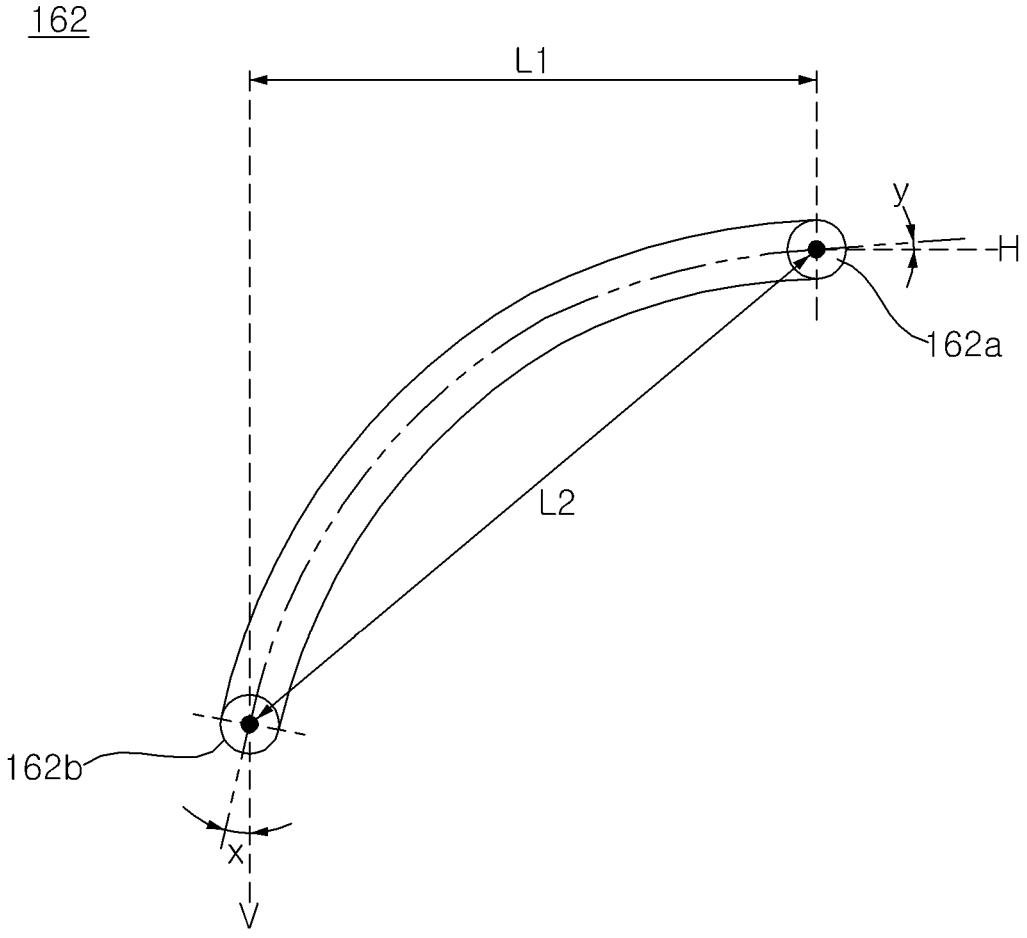
FIG. 12 is a side cross-sectional view of an air guide according to the second embodiment of the present disclosure.
Figure 13:
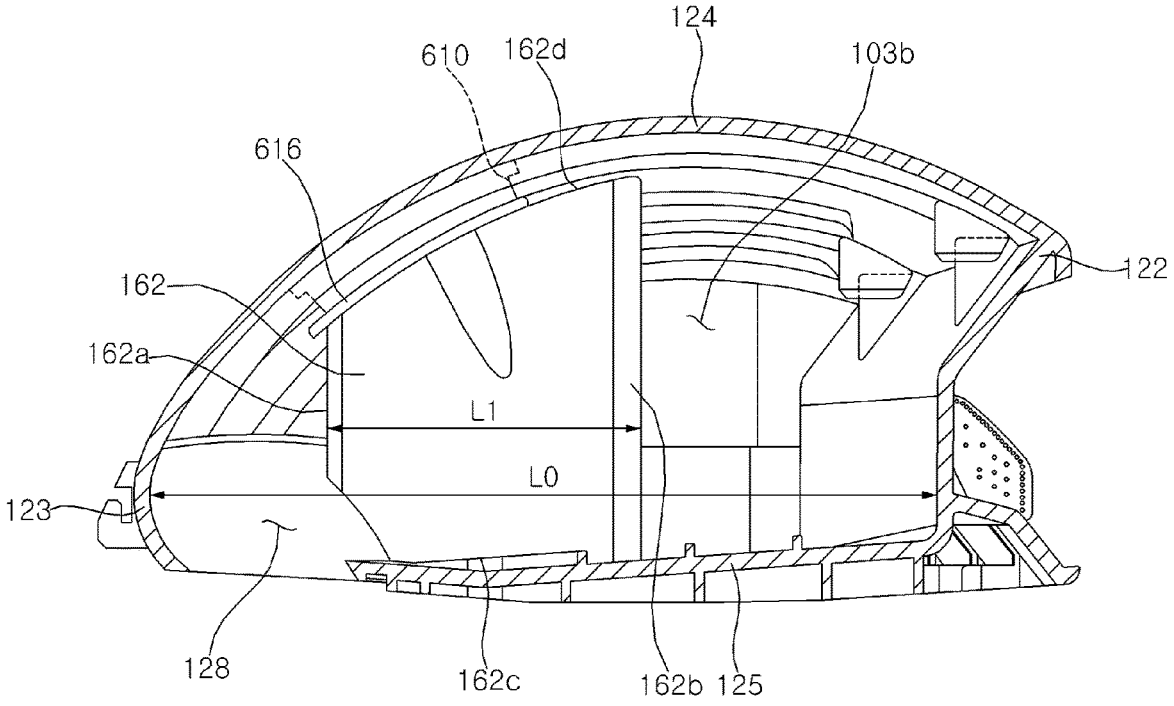
FIG. 13 is a bottom view of a second tower according to the second embodiment of the present disclosure.

Alternatively, according to the first embodiment, referring to FIG. 10, the blower 1 may further include a bar link 600 to which a plurality of air guides 160 are connected respectively. In this case, the above-described opening 610 of the outer wall of the tower may be omitted.

The bar link 600 may extend in a direction in which the plurality of air guides 160 are arranged, for example, in the up-down direction. Each of the air guides 160 may be penetrated and connected to the bar link 600. The bar link 600 may vertically penetrate the center portion in the left-right direction of the front end of each air guide 160. One end 600*a* and the other end 600*b* of the bar link 600 may be fastened respectively to the inner wall of the tower. Accordingly, the fastening convenience of the plurality of air guides may be improved, by reducing the hassle of fastening each of the plurality of air guides to the tower and by simply inserting the bar link into the tower inner space and fastening it to the tower.

In addition, when each air guide 160 is fastened to the bar link 600 by a fitting method, each air guide 160 may be moved in the up-down direction along the bar link 600 by an external force of a certain magnitude or more. Therefore, it is possible to flexibly respond to a situation in which the air flow path is changed, such as an additional disposition of structure in the tower, by moving the position of the air guide to an appropriate place as necessary.

Referring to FIGS. 11 to 14, according to a second embodiment of the present disclosure, unlike the above-described first embodiment, a single air guide 160 may be provided. In order to replace a plurality of air guides with only a single air guide, the single air guide needs to be provided at a certain position and in a certain shape, as will be described below. Hereinafter, for convenience, a description will be made based on the second air guide 162 disposed in the second tower 120.

According to the present embodiment, the air guide 162 has a shape that is convex upwardly. According to the present embodiment, the other end 162*a* of the air guide 162 is disposed higher than the one end 162*b*.

At this time, one end 162*b* of the air guide may be understood as an upstream end for air flow, and the other end 162*a* of the air guide may be understood as a downstream end for air flow. Alternatively, one end 162*b* of the air guide may be understood as a front end based on the aforementioned front-rear direction, and the other end 162*a* may be understood as a rear end based on the aforementioned front-rear direction.

According to the present embodiment, one end 162*b* of the air guide 162 is disposed in the vicinity of the middle between the front end 122 of the tower and the rear end 123.

The vicinity of the middle between the front end 122 and the rear end 123 of the tower may mean a portion of 40% to 60% of the length ranging from the front end 122 of the tower to the rear end 123. In addition, the other end 162*a* of the air guide 162 may be disposed close to the discharge port 127 formed adjacent to the rear end 123 of the tower.

Accordingly, the length L1 from one end 162*b* to the other end 162*a* of the air guide 162 on a flat cross-section may be formed to be a half or a value close to half of a width L0 of a flow path inside the tower (or a width in the front-rear direction inside the tower) on a flat cross-section. In addition, the air guide 162 on a flat cross-section may be formed to occupy an area from the front end 122 of the tower to the vicinity of a half toward the rear end 123 (refer to FIG. 13).

According to the present embodiment, the other end 162*a* of the air guide 162 is disposed in the vicinity of the middle of a vertical height of the discharge port 127.

The vicinity of the middle of the vertical height of the discharge port 127 may mean a portion of 40% to 60% of the length ranging from the lower end 127*f* to the upper end 127*e* of the discharge port.

In general, the air discharged from the blower fan has a strong property of a straight wind that blows toward the upper side from the lower side, when the internal space of the tower is narrow against the output of the blower fan. Accordingly, one end of the air guide is disposed in the vicinity of the middle between the front end and the rear end of the tower, and the other end of the air guide is disposed in the vicinity of the middle of the vertical height of the discharge port, so that about half of the air discharged from the blower fan is discharged through the lower part of the air guide among the discharge port, and the other half of the air is discharged through the upper part of the air guide among the discharge port. That is, the air discharged from the blower fan can be evenly distributed over the entire surface of the discharge port formed elongated in the up-down direction only by a single air guide.

Meanwhile, according to the present embodiment, one end portion of the air guide 162 may have an inclination of 0° to 30° with respect to a virtual vertical line V from the one end 162*b*. That is, the value x of FIG. 12 may be formed in a range of 0° to 30°. The value x may be referred to as an inlet angle of the air guide (refer to FIG. 12).

Since an inlet end (or an upstream end) of the air guide has a certain inclination, the air discharged upward from the fan is smoothly transferred in the front-rear direction, thereby minimizing the pressure loss due to the change of the air flow direction.

According to the present embodiment, the other end portion of the air guide 162 may have an inclination of −10° to 10° with respect to a virtual horizontal line H from the other end 162*a*. That is, the value y of FIG. 12 may be formed in a range of −10° to 10°. The value y may be referred to as an outlet angle of the air guide (refer to FIG. 12).

Since an outlet end (or a downstream end) of the air guide has an inclination close to horizontal, the air passing through the surface of the air guide can flow in the front-rear direction.

According to the present embodiment, the length L1 in the front-rear direction of the air guide 162 may be the same as or similar to the length in the up-down direction of the air guide 162. That is, a straight line distance L2 connecting one end 162*b* and the other end 162*a* of the air guide may be formed to have a length that is about 40 to 60% longer than a distance L1 between the one end 162*b* and the other end 162*a* of the air guide 162 on a flat cross-section (refer to FIG. 12).

Therefore, it is possible to effectively guide the flow direction while preventing the occurrence of a vortex due to the excessive increase of the air guide by forming the air guide with an appropriate length, In the present embodiment, the direction of flow discharged from the fan is smoothly switched to the discharge port side with only a single air guide, and the air volume can be uniformly distributed over the entire area of the elongated discharge port, by disposing an air guide formed in a certain shape at a certain position inside the blower as described above, thereby lowering a flow resistance compared to a case when a plurality of air guides are provided, and improving the manufacturability and economic feasibility of the air guide.

Meanwhile, according to the present embodiment, the air guide 162 includes one side end 162*d* connecting one sides of one end 162*b* and the other end 162*a*, and the other side end 162*c* connecting the other sides of one end 162*b* and the other end 162*a*, and the one side end 162*d* and the other side end 162*c* may be in close contact with the inner wall of the tower respectively, as described above in the first embodiment (refer to FIG. 13).

Therefore, it is possible to prevent the air flow from leaking through unnecessary gaps, by removing unnecessary play by attaching the side end of the air guide to the inner wall of the tower, thereby improving the performance of the air guide.

In addition, an opening 610 is formed in the outer wall 124 of the tower, and an extension 616 is formed in the side end of the air guide so as to correspond to the opening 610, so that the air guide may be inserted into and fastened to the opening 610, as described above (refer to FIG. 13).

Figure 14:
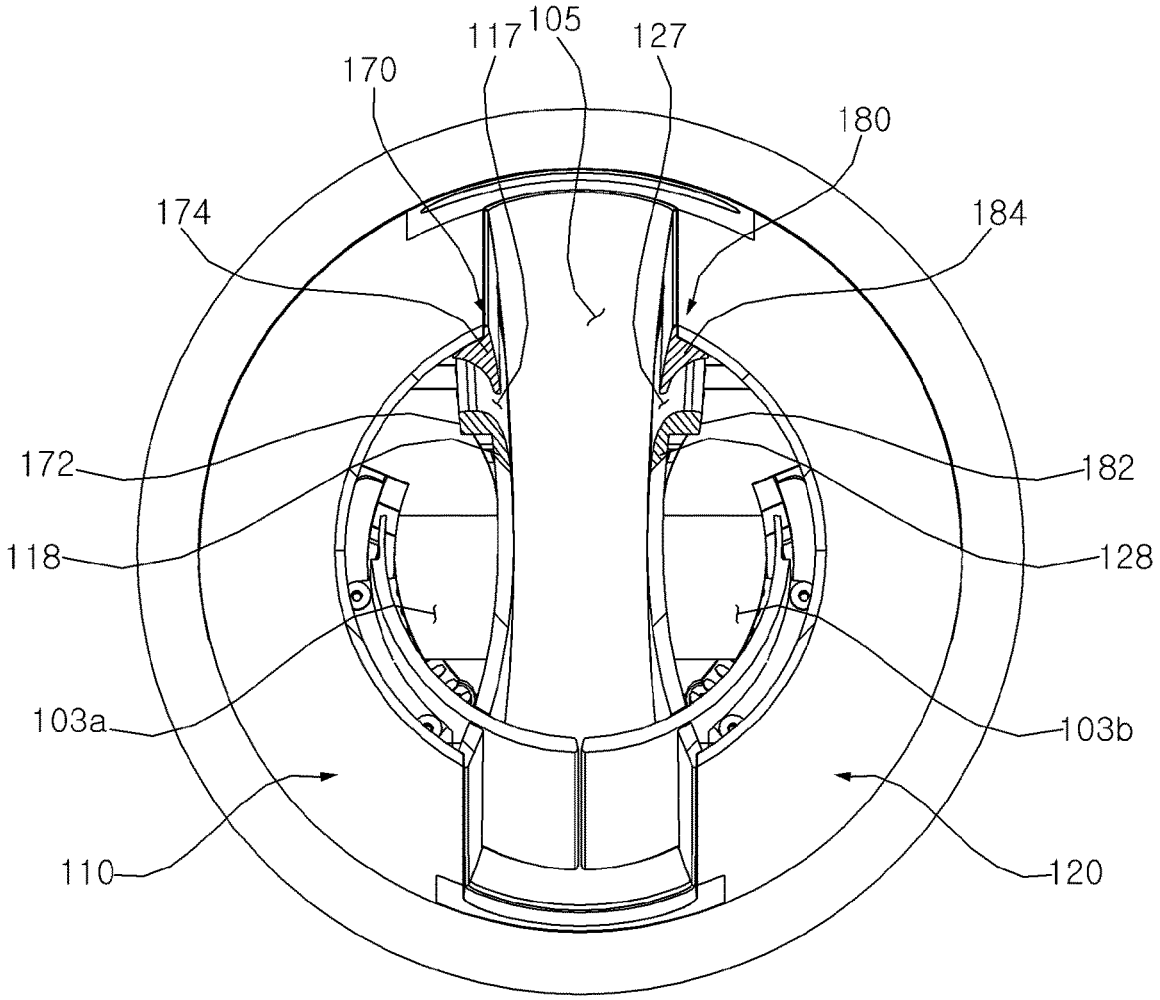
FIG. 14 is a plan cross-sectional view taken along line IX-IX of FIG. 3.
Figure 15:
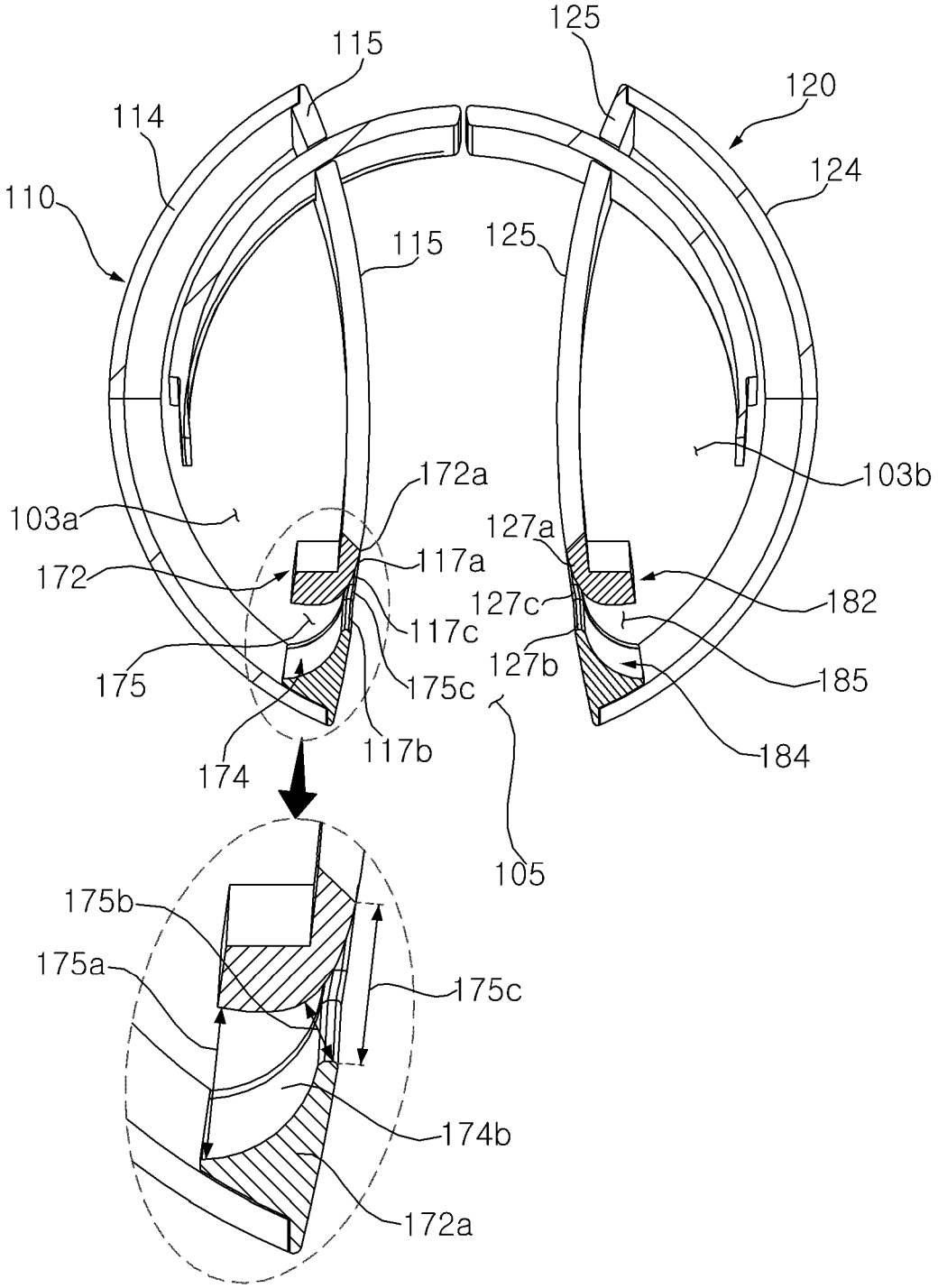
FIG. 15 is a bottom cross-sectional view taken along line IX-IX of FIG. 3.

FIG. 14 is a plan cross-sectional view taken along line IX-IX of FIG. 3, and FIG. 15 is a bottom cross-sectional view taken along line IX-IX of FIG. 3.

Referring to FIG. 5, FIG. 14 or FIG. 15, the first discharge port 117 of the first tower 110 may be disposed to face the second tower 120, and the second discharge port 127 of the second tower 120 may be disposed to face the first tower 110.

The air discharged from the first discharge port 117 may cause the air to flow along the inner wall 115 of the first tower 110 through the Coanda effect. The air discharged from the second discharge port 127 may cause the air to flow along the inner wall 125 of the second tower 120 through the Coanda effect.

In the present embodiment, the first discharge case 170 and the second discharge case 180 may be further included.

The first discharge port 117 may be formed in the first discharge case 170, and the first discharge case 170 may be assembled to the first tower 110. The second discharge port 127 may be formed in the second discharge case 180, and the second discharge case 180 may be assembled to the second tower 120.

The first discharge case 170 may be installed to penetrate the inner wall 115 of the first tower 110, and the second discharge case 180 may be installed to penetrate the inner wall 125 of the second tower 120.

A first discharge opening 118 in which the first discharge case 170 is installed may be formed in the first tower 110, and a second discharge opening 128 in which the second discharge case 180 is installed may be formed in the second tower 120.

The first discharge case 170 may include a first discharge guide 172 that can form the first discharge port 117 and is disposed in the air discharge side of the first discharge port 117, and a second discharge guide 174 that can form the first discharge port 117 and is disposed in the opposite side of the air discharge side of the first discharge port 117.

An outer surface 172*a*, 174*a* of the first discharge guide 172 and the second discharge guide 174 may provide a part of the inner wall 115 of the first tower 110.

The inner side of the first discharge guide 172 may be disposed to face the first discharge space 103*a*, and the outer side may be disposed to face the blowing space 105. The inner side of the second discharge guide 174 may be disposed to face the first discharge space 103*a*, and the outer side may be disposed to face the blowing space 105.

The outer surface 172*a* of the first discharge guide 172 may be formed in a curved surface. The outer surface 172*a* may provide a surface continuous with the first inner wall 115. In particular, the outer surface 172*a* forms a curved surface continuous with the outer surface of the first inner wall 115.

The outer surface 174*a* of the second discharge guide 174 may provide a surface continuous with the first inner wall 115. The inner surface 174*b* of the second discharge guide 174 may be formed in a curved surface. In particular, the inner surface 174*b* may form a curved surface continuous with the inner surface of the first outer wall 115, and through this, the air in the first discharge space 103*a* may be guided toward the first discharge guide 172.

The first discharge port 117 may be formed between the first discharge guide 172 and the second discharge guide 174, and the air in the first discharge space 103*a* may be discharged to the blowing space 105 through the first discharge port 117.

Specifically, the air of the first discharge space 103*a* may be discharged to a gap between the outer surface 172*a* of the first discharge guide 172 and the inner surface 174*b* of the second discharge guide 174, and the gap between the outer surface 172*a* of the first discharge guide 172 and the inner surface 174*b* of the second discharge guide 174 is defined as a discharge interval 175.

The discharge interval 175 forms a certain channel.

In the discharge interval 175, the width of a middle portion 175*b* may be formed narrower in comparison with an inlet 175*a* and an outlet 175*c*. The middle portion 175*b* is defined as the shortest distance between the second border 117*b* and the outer surface 172*a*.

The cross-sectional area may be gradually decreased from the inlet of the discharge interval 175 to the middle portion 175*b*, and the cross-sectional area may be increased again from the middle portion 175*b* to the outlet 175*c*. The middle portion 175*b* may be located inside the first tower 110. When viewed from the outside, the outlet 175*c* of the discharge interval 175 may be seen as the discharge port 117.

In order to induce the Coanda effect, the radius of curvature of the inner surface 174*b* of the second discharge guide 174 may be greater than the radius of curvature of the outer surface 172*a* of the first discharge guide 172.

The center of curvature of the outer surface 172*a* of the first discharge guide 172 may be located in front of the outer surface 172*a*, and may be formed inside the first discharge space 103*a*. The center of curvature of the inner surface 174*b* of the second discharge guide 174 may be located in the first discharge guide 172 side, and may be formed inside the first discharge space 103*a*.

The second discharge case 180 may include a first discharge guide 182 that forms a second discharge port 127, and is disposed in the air discharge side of the second discharge port 127, and a second discharge guide 184 that forms the second discharge port 127, and is disposed in the opposite side of the air discharge side of the second discharge port 127.

A discharge interval 185 may be formed between the first discharge guide 182 and the second discharge guide 184.

Since the second discharge case 180 may be bilaterally symmetrical with the first discharge case 170, a detailed description thereof will be omitted.

Meanwhile, the blower 1 may further include an air flow converter 400 for changing the air flow direction of the blowing space 105.

Figure 16:
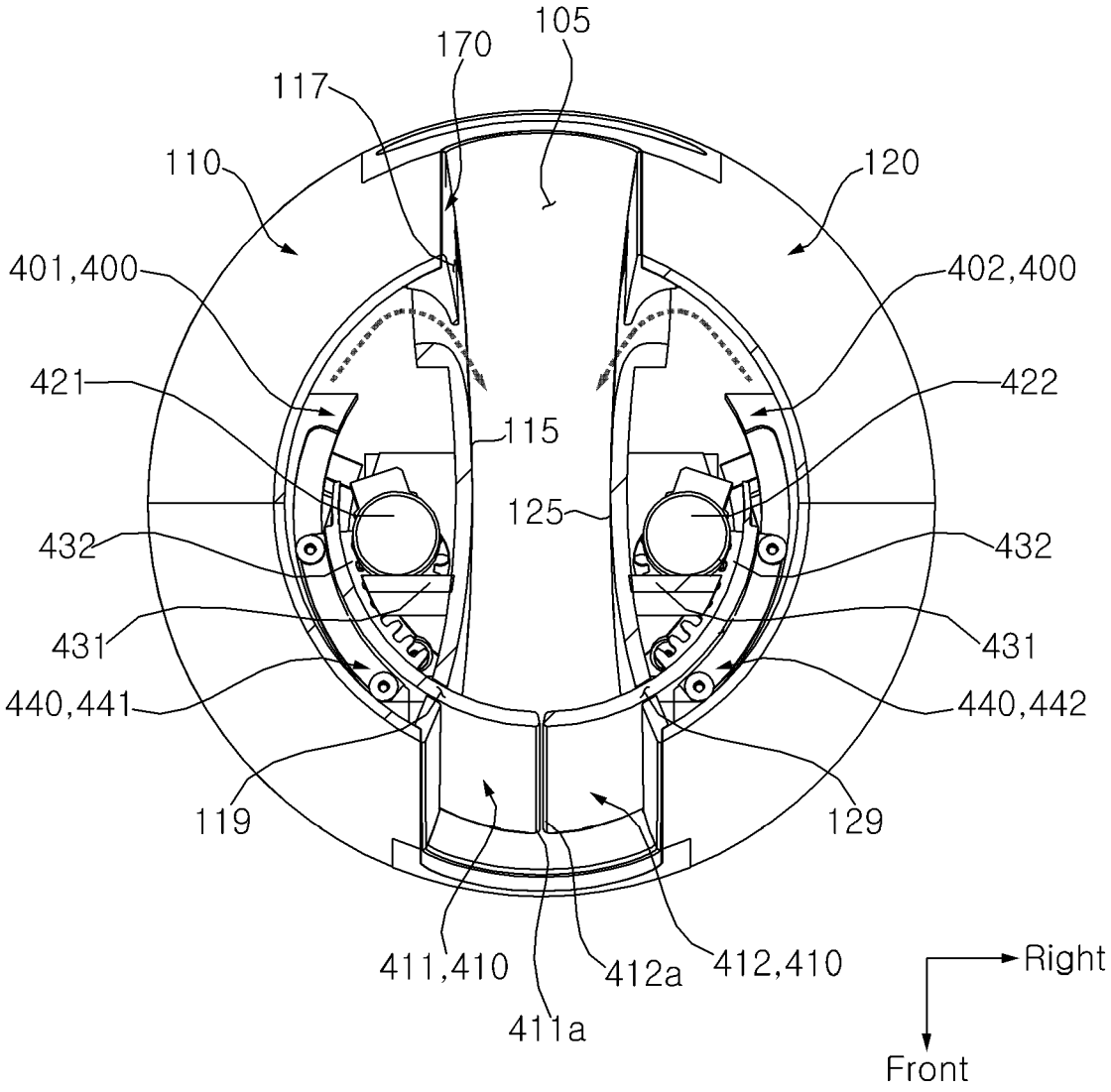
FIG. 16 is a plan cross-sectional view showing an airflow converter of FIG. 2.

FIG. 16 is a plan sectional view showing the airflow converter of FIG. 2. The airflow converter 400 capable of forming an upward airflow will be described with reference to FIG. 7 or FIG. 16.

In the present embodiment, the airflow converter 400 may convert the horizontal airflow flowing through the blowing space 105 into an upward airflow.

The airflow converter 400 may include a first airflow converter 401 disposed in the first tower 110 and a second airflow converter 402 disposed in the second tower 120. The first airflow converter 401 and the second airflow converter 402 are bilaterally symmetrical, and have the same configuration.

The airflow converter 400 may include a guide board 410 that can be disposed in the tower and protrudes into the blowing space 105, a guide motor 420 that provides a driving force for the movement of the guide board 410, a power transmission member 430 that provides the driving force of the guide motor 420 to the guide board 410, and a board guider 440 that is disposed inside the tower and guides the movement of the guide board 410.

The guide board 410 may be hidden inside the tower, and may protrude into the blowing space 105 when the guide motor 420 is operated.

In the present embodiment, the guide board 410 may include a first guide board 411 disposed in the first tower 110 and a second guide board 412 disposed in the second tower 120.

To this end, a board slit 119 penetrating the inner wall 115 of the first tower 110 may be formed, and a board slit 129 penetrating the inner wall 125 of the second tower 120 may be formed, respectively.

The board slit 119 formed in the first tower 110 is referred to as a first board slit 119, and the board slit formed in the second tower 120 is referred to as a second board slit 129.

The first board slit 119 and the second board slit 129 may be disposed to be bilaterally symmetrical. The first board slit 119 and the second board slit 129 may be formed to extend long in the up-down direction. The first board slit 119 and the second board slit 129 may be disposed to be inclined with respect to the vertical direction V.

The front end 112 of the first tower 110 may be formed at a first inclination when the vertical direction is 0 degree, and the first board slit 119 is formed at a second inclination. The front end 122 of the second tower 120 may also be formed at a first inclination, and the second board slit 129 may be formed at a second inclination.

The first inclination may be formed as between a vertical direction and the second inclination, and the second inclination may be greater than a horizontal direction. The first inclination and the second inclination may be the same, or the second inclination may be greater than the first inclination.

The guide board 410 may be formed in a flat or curved plate shape. The guide board 410 may be formed to extend long in the up-down direction, and may be disposed in front of the blowing space 105.

The guide board 410 may block the horizontal airflow flowing into the blowing space 105 and change the direction in the upward direction.

In the present embodiment, an inner end 411*a* of the first guide board 411 and an inner end 412*a* of the second guide board 412 may come into contact with or close to each other to form an upward airflow. Unlike the present embodiment, a single guide board 410 may be in close contact with the opposite tower to form an upward airflow.

When the airflow converter 400 is not operated, the inner end 411*a* of the first guide board 411 may close the first board slit 119, and the inner end 412*a* of the second guide board 412 may close the second board slit 129.

When the airflow converter 400 is operated, the inner end 411*a* of the first guide board 411 may protrude into the blowing space 105 by penetrating the first board slit 119, and the inner end 412*a* of the second guide board 412 may protrude into the blowing space 105 by penetrating the second board slit 129.

In the present embodiment, the first guide board 411 and the second guide board 412 may protrude into the blowing space 105 by a rotation operation. Unlike the present embodiment, it is natural that at least one of the first guide board 411 and the second guide board 412 can be linearly moved in a slide manner to protrude into the blowing space 105.

In a top view, the first guide board 411 and the second guide board 412 may be formed in an arc shape. The first guide board 411 and the second guide board 412 may form a certain radius of curvature, and the center of curvature may be located in the blowing space 105.

When the guide board 410 is hidden inside the tower, it is preferable that the radially inner volume of the guide board 410 is larger than the radially outer volume.

The guide board 410 may be formed of a transparent material. A light emitting member such as an LED may be disposed in the guide board 410, and the entire guide board 410 may emit light through a light generated from the light emitting member. The light emitting member may be disposed in the discharge space 103 inside the tower, and may be disposed in the outer end of the guide board 410.

The guide motor 420 may include a first guide motor 421 providing a rotational force to the first guide board 411, and a second guide motor 422 providing a rotational force to the second guide board 412.

The first guide motor 421 may be disposed in the upper side and the lower side, respectively, inside the first tower, and if necessary, it may be divided into an upper first guide motor 421 and a lower first guide motor 421. The upper first guide motor is disposed lower than the upper end 111 of the first tower 110, and the lower first guide motor is disposed higher than the fan 320.

The second guide motor 422 may also be disposed in the upper side and the lower side, respectively, inside the second tower, and if necessary, it may be divided into an upper second guide motor 422*a* and a lower second guide motor 422*b*. The upper second guide motor may be disposed lower than the upper end 121 of the second tower 120, and the lower second guide motor may be disposed higher than the fan 320.

In the present embodiment, the rotation shafts of the first guide motor 421 and the second guide motor 422 may be disposed in a vertical direction, and a rack-pinion structure may be used to transmit a driving force.

The power transmission member 430 may include a driving gear 431 coupled to the motor shaft of the guide motor 420, and a rack 432 coupled to the guide board 410.

The driving gear 431 may be a pinion gear, and may be rotated in a horizontal direction.

The rack 432 may be coupled to the inner surface of the guide board 410. The rack 432 may be disposed in the discharge space 103, and may turn round along with the guide board 410.

The board guider 440 may guide the turning movement of the guide board 410. The board guider 440 may support the guide mode 410 when the guide board 410 turns round.

In the present embodiment, the board guider 440 may be disposed in the opposite side of the rack 432 based on the guide board 410. The board guider 440 may support a force applied from the rack 432. Unlike the present embodiment, it is natural that a groove corresponding to the turning radius of the guide board may be formed in the board guider 440, and the guide board may be moved along the groove.

The board guider 440 may be assembled to the outer wall 114, 124 of the tower. The board guider 440 may be disposed radially outward based on the guide board 410, thereby minimizing contact with the air flowing through the discharge space 103.

Figure 17:
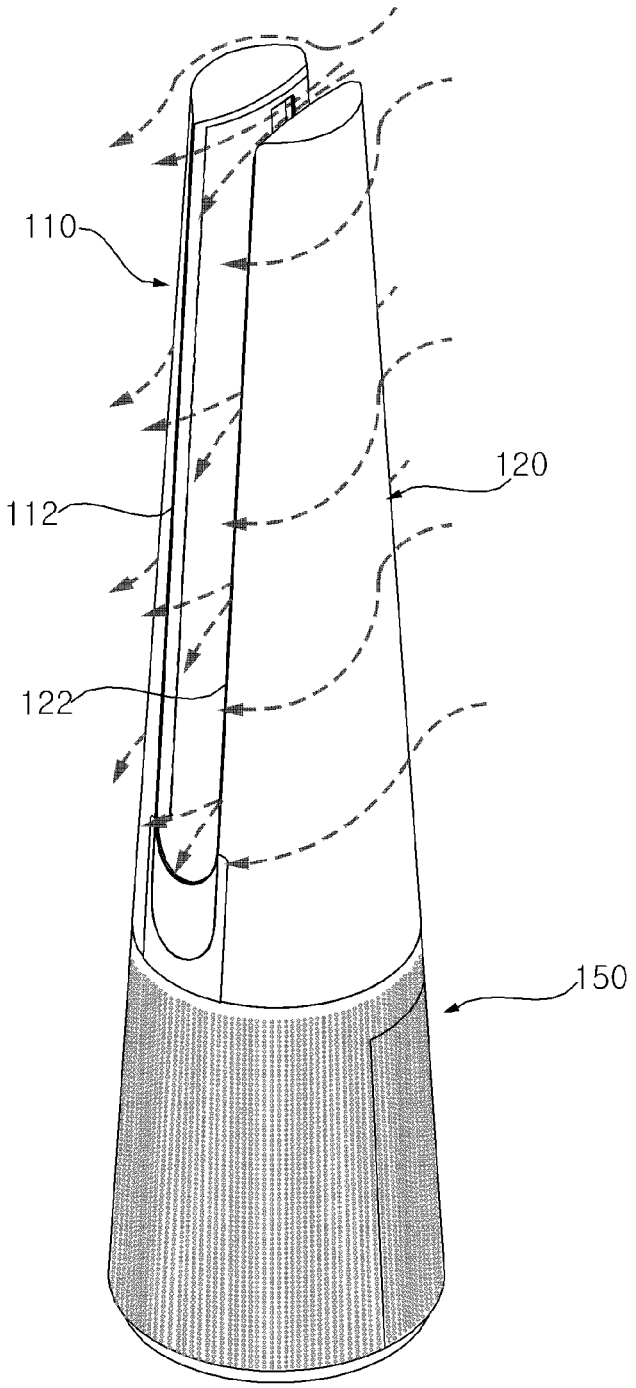
FIG. 17 is an exemplary view showing a horizontal airflow of the blower according to an embodiment of the present disclosure.

FIG. 17 is an exemplary view showing a horizontal airflow of the blower according to an embodiment of the present disclosure.

Referring to FIG. 17, when a horizontal airflow is provided, the first guide board 411 is hidden inside the first tower 110, and the second guide board 412 is hidden inside the second tower 120.

The discharge air of the first discharge port 117 and the discharge air of the second discharge port 127 may be merged in the blowing space 120, and may flow forward through the front end 112, 122.

In addition, after the air behind the blowing space 105 is guided into the blowing space 105, it may flow forward.

In addition, the air around the first tower 110 may flow forward along the first outer wall 114, and the air around the second tower 120 may flow forward along the second outer wall 124.

The first discharge port 117 and the second discharge port 127 extend long in the up-down direction and are disposed bilaterally symmetrical, thereby more uniformly forming an air flowing in the upper side of the first discharge port 117 and the second discharge port 127 and an air flowing in the lower side of the first discharge port 117 and the second discharge port 127.

In addition, the air discharged from the first discharge port and the second discharge port are joined in the blowing space, thereby improving the straightness of the discharged air and allowing the air to flow farther away.

Figure 18:
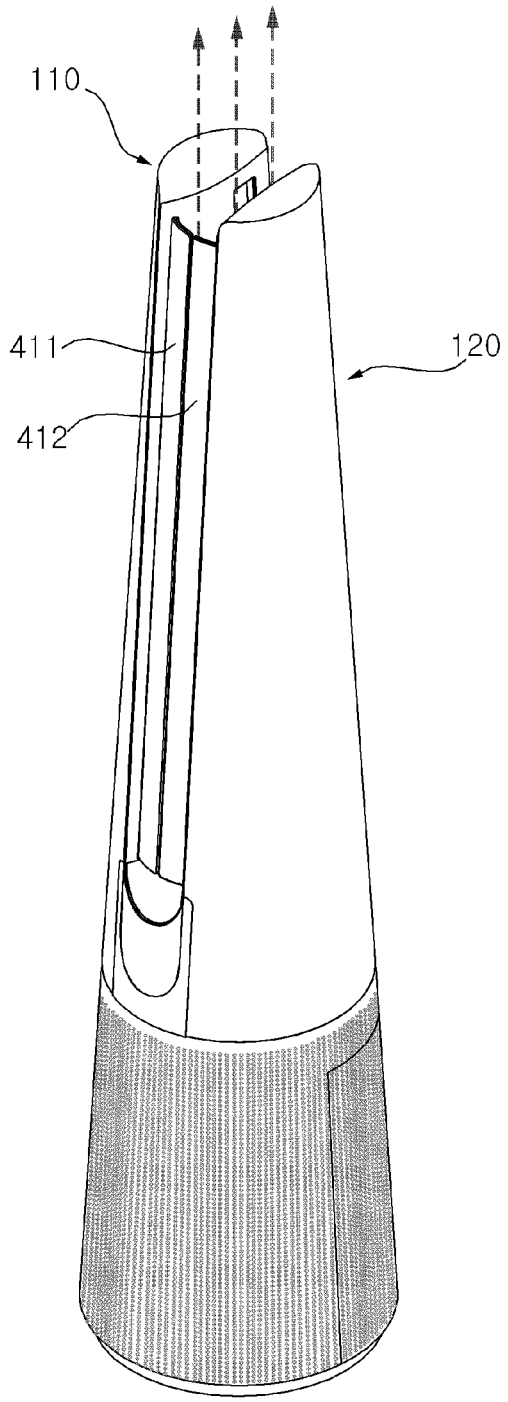
FIG. 18 is an exemplary view showing an upward airflow of the blower according to an embodiment of the present disclosure.

FIG. 18 is an exemplary view showing an upward airflow of the blower according to a first embodiment of the present disclosure.

Referring to FIG. 18, when an upward airflow is provided, the first guide board 411 and the second guide board 412 protrude into the blowing space 105, and block the front of the blowing space 105.

As the front of the blowing space 105 is blocked by the first guide board 411 and the second guide board 412, the air discharged from the discharge port 117, 127 flows upward along the rear surfaces of the first guide board 411 and the second guide board 412, and is discharged to the upper portion of the blowing space 105.

The discharge air may be suppressed from directly flowing to a user by forming an upward airflow in the blower 1. In addition, when it is desired to circulate indoor air, the blower 1 may be operated by an upward airflow.

For example, when the air conditioner and the blower are used simultaneously, the blower 1 may be operated by an upward airflow to promote convection of indoor air, and the indoor air may be more rapidly cooled or heated.

The blower according to the present disclosure has one or more of the following effects.

The present disclosure may provide a blower that evenly guides the air flowing from the lower side to the upper side inside the tower to the discharge port by providing an air guide.

The present disclosure may provide a blower that effectively maintains the blowing performance while solving the problem caused as a plurality of air guides are provided, by providing a single air guide disposed at a certain position in a certain shape.

The present disclosure may improve the manufacturability and economy of the blower by providing the above-described single air guide.

The present disclosure may provide a blower with a simple installation process by providing a bar link or an insertion part that improves the installation property even with a plurality of air guides.

The present disclosure may provide a blower that can respond by flexibly changing the installation position of the air guide according to the condition of the flow path inside the blower by utilizing the bar link.

While the present disclosure has been particularly shown and described with reference to exemplary embodiments thereof, it will be understood by those of ordinary skill in the art that various changes in form and detail may be made herein without departing from the spirit and scope of the present disclosure as defined by the following claims and such modifications and variations should not be understood individually from the technical idea or aspect of the present disclosure.

What is claimed is:

1. A blower comprising:

a lower case having a suction port;

an upper case which is disposed in an upper side of the lower case, and has a pair of towers that are spaced apart from each other and form a blowing space through which a discharge air flows therebetween; and a blower fan which is disposed inside the lower case and discharges air to the upper case, wherein each of the pair of towers has a discharge port that is elongated in an up-down direction and disposed closer to a rear end of the respective tower than a front end, and each of the pair of towers has an air guide, which is disposed therein, that guides the air discharged by the blower fan to the respective discharge port, wherein the air guide in each of the pair of towers is convex upward, has one end disposed near a middle between the front end and the rear end of the respective tower, and has the other end disposed near a middle of a vertical height of the respective discharge port, wherein the other end is disposed higher than the one end, wherein the respective tower has a cross-sectional area of internal space that becomes narrower toward an upper side, wherein the respective air guide in each of the pair of towers is singular, wherein the one end of the respective air guide in each of the pair of towers is disposed in a portion of 40% to 60% of a length from the front end of the respective tower to the rear end, wherein the other end of the respective air guide m each of the pair of towers as disposed in a portion of 40% to 60% of a length from a lower end of the respective discharge port to an upper end and;

wherein a length in a front-rear direction of the respective air guide in each of the pair of towers is the same as a length in an up-down direction of the air guide in each of the pair of towers.

2. The blower of claim 1, wherein one end portion of the respective air guide in each of the pair of towers has an inclination of 0° to 30° with respect to a virtual vertical line from the one end.

3. The blower of claim 2, wherein the other end portion of the respective air guide in each of the pair of towers has an inclination of −10° to 10° with respect to a virtual horizontal line from the other end.

4. The blower of claim 1, wherein the one end of the respective air guide in each of the pair of towers is an upstream end disposed in the blower fan side, and the other end in each of the pair of towers is a downstream end disposed in the respective discharge port side.

5. The blower of claim 1, wherein the respective air guide in each of the pair of towers has one side end connecting one side of the respective one end and the respective other end, and has the other side end connecting the other side of the respective one end and the respective other end, wherein the respective one side end and the respective other side end are respectively in direct contact with an inner wall of the respective tower.

6. The blower of claim 1, wherein the pair of towers are a first tower and a second tower that are symmetrical to each other based on the blowing space, wherein the discharge port has a first discharge port provided in the first tower and a second discharge port provided in the second tower, and wherein the air guide has a first air guide disposed inside the first tower and a second air guide disposed inside the second tower.

7. The blower of claim 6, wherein the blowing space is opened at a front and a rear, wherein the first tower has a first inner wall that faces the blowing space and forms a portion of a perimeter of the first tower, and a first outer wall forming a remainder of the perimeter of the first tower, wherein the second tower has a second inner wall that faces the blowing space and forms a portion of a perimeter of the second tower, and a second outer wall forming a remainder of the perimeter of the second tower, and wherein the first discharge port is provided in the first inner wall so that discharge air flows along the inner wall of the first tower, and the second discharge port is provided in the second inner wall so that discharge air flows along the inner wall of the second tower.

8. A blower comprising:

a lower case having a suction port;

an upper case which is disposed in an upper side of the lower case, and has a pair of towers that are spaced apart from each other and form a blowing space through which a discharge air flows therebetween; and a blower fan which is disposed inside the lower case and discharges air to the upper case, wherein each of the pair of towers has a discharge port that is elongated in an up-down direction and disposed closer to a rear end of the tower than a front end, and has a plurality of air guides, which are disposed therein, that guide the air discharged by the blower fan to the discharge port, wherein the plurality of air guides are respectively connected to a bar link elongated in an up-down direction, wherein the bar link is connected to an inner wall of the tower, wherein the plurality of air guides move vertically along the bar link.

9. A blower comprising:

a lower case having a suction port;

an upper case which is disposed in an upper side of the lower case, and has a pair of towers that are spaced apart from each other and form a blowing space through which a discharge air flows therebetween; and a blower fan which is disposed inside the lower case and discharges air to the upper case, wherein each of the pair of towers has a discharge port that is elongated in an up-down direction and disposed closer to a rear end of the tower than a front end, and has an air guide, which is disposed therein, that guides the air discharged by the blower fan to the discharge port, wherein the tower has an opening into which the air guide is inserted, wherein the opening is divided into one end portion facing an inner space of the tower and the other end portion facing the outside, wherein the other end portion has a larger cross-sectional area than the one end portion.

* * * * *